US007114867B2

(12) United States Patent
Ohashi et al.

(10) Patent No.: US 7,114,867 B2
(45) Date of Patent: Oct. 3, 2006

(54) BOTH-SIDE RECORDING APPARATUS

(75) Inventors: Tetsuyo Ohashi, Kanagawa (JP); Koya Iwakura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/822,658

(22) Filed: Apr. 13, 2004

(65) Prior Publication Data

US 2004/0207706 A1 Oct. 21, 2004

(30) Foreign Application Priority Data

Apr. 18, 2003 (JP) ..... 2003-113914

(51) Int. Cl.

| | |
|---|---|
| ***B41J 13/03*** | (2006.01) |
| ***B65H 85/00*** | (2006.01) |
| ***B65H 15/00*** | (2006.01) |
| *B41J 3/60* | (2006.01) |
| *B41J 13/10* | (2006.01) |

(52) U.S. Cl. ..... 400/642; 400/188; 271/225; 271/186; 271/301

(58) Field of Classification Search ..... 271/225, 271/186, 301; 400/642, 188
See application file for complete search history.

(56) References Cited

U.S. PATENT DOCUMENTS 5,772,343 A * 6/1998 Beretta et al. ..... 400/624
5,988,809 A * 11/1999 Yokoi et al. ..... 347/104
6,257,783 B1 * 7/2001 Hanaoka et al. ..... 400/578
6,332,068 B1 12/2001 Blackman et al. ..... 399/364
6,679,599 B1 * 1/2004 Jurrens et al. ..... 347/102

FOREIGN PATENT DOCUMENTS

| | | | |
|---|---|---|---|
| JP | 2001261181 A | * | 9/2001 |
| JP | 2002-59598 | | 2/2002 |
| JP | 2002127541 A | * | 5/2002 |
| JP | 2003002491 A | * | 1/2003 |

OTHER PUBLICATIONS

Machine translation of JP 2001261181 to Asada from Japanese Patent Office website.*
Machine translation of JP 2002-127541 to Shimomura et al. from Japanese Patent Office website.*

* cited by examiner

*Primary Examiner*—Daniel J. Colilla
(74) *Attorney, Agent, or Firm*—Fitzpatrick, Cella, Harper & Scinto

(57) ABSTRACT

In a recording apparatus including an inversion unit for inverting a recording sheet recorded on a side in a recording unit by conveying along a predetermined path and returning the recording sheet to the recording unit, the possibility of peeling of recording material from the recorded surface or re-deposition of the recording material onto the recording sheet can be reduced. The recording sheet subjected to recording on a side in the recording unit having a recording head is conveyed to the inversion unit, which includes, at a recorded side of the recording sheet, two both-side rollers which are driven and are formed of an elastic material, and, at a non-recorded side, two both-side pinch rollers which are formed of a non-elastic material. The inversion unit conveys the recording sheet along a turnaround path with the recorded side inside, thereby inverting and returning the recording sheet to the recording unit.

7 Claims, 23 Drawing Sheets

| FIG. 20A |
| --- |
| FIG. 20B |

BOTH-SIDE RECORDING APPARATUS

BACKGROUND OF THE INVENTION

1. Field of the Invention

The present invention relates to a both-side recording apparatus capable of automatic both-side recording on a recording sheet, and particularly to an ink jet recording apparatus for recording with an ink jet process. The present invention relates particularly to an arrangement of a conveying roller and a configuration in a front-back side inversion apparatus.

2. Related Background Art

For automatic both-side recording in an ink jet recording apparatus, several methods have been commercialized or proposed. In these methods, after recording on a front side (top side) of a recording sheet, the conveying direction thereof is reversed to feed the recording sheet into a front-back side inverting apparatus, and, after an inverting operation, the recording sheet is conveyed again by the same sheet conveying unit as in the recording operation on the front side to execute recording on the back side of the recording sheet by the same recording unit.

Among these methods, U.S. Pat. No. 6,332,068 discloses an invention in which the front-back side inverting apparatus is provided with two drive rollers whereby the conveying direction of the recording sheet is inverted by 180° along a conveying path. In the prior apparatus of such configuration, the recording sheet is conveyed with a recorded surface outside in the front-back side inversion apparatus. Also a configuration of inverting the conveying direction of the recording sheet by 180° by a main drive roller and an auxiliary drive roller is known, for example, in Japanese Patent Application Laid-open No. 2002-59598. Also in the apparatus of such configuration, as in the aforementioned example, the recording sheet is conveyed with a recorded surface outside in the front-back side inversion apparatus.

However, these prior examples have been associated with certain limitations.

More specifically, there is considered generation of an axial loss by a certain reason between a supporting axis of an idler roller and the idler roller in the front-back side inversion apparatus, and, in case such torque becomes unnegligible in comparison with the torque of a frictional force which the idler roller receives from the recording sheet, the idler roller may cause a defective rotation. In such case, in the prior technology in which the drive roller is in contact with a non-recorded surface of the recording sheet and the idler roller is in contact with the recorded surface of the recording sheet, a defective rotation of the idler roller may cause a friction or scrape between the idler roller and the recorded surface of the recording sheet thereby causing a detrimental influence on the recorded result such as a partial peeling of a recording material (or recording agent) if the recorded recording material is not completely fixed.

Also as the non-recorded surface of the recording sheet is contacted with an elastic member while the recorded surface of the recording sheet is contacted with a non-elastic member, the surface of the roller contacting the recorded surface is often a smooth surface of a low friction coefficient. For this reason, in case the recording material remains on the roller contacting the recorded surface, for example it is peeled and remains on the idler roller as explained before, it involves a risk of re-deposition in another portion of the recording sheet thereby resulting in a fear of deteriorating the recorded result.

Also in case of conveying with the recorded surface outside as in the prior technology, a roller contacting the recorded surface of the recording sheet has a relatively smaller diameter, whereby a given portion on the circumference of the roller has a higher frequency of contacting the recorded portion, whereby a possibility that the recording material peeled as explained before is accumulated on the roller and is re-deposited onto the recording sheet is elevated.

SUMMARY OF THE INVENTION

An object of the present invention is to provide a both-side recording apparatus including an inverting unit for inverting a recording sheet, recorded on a surface thereof in a recording unit, by conveying along a predetermined path and returning it to the recording unit, capable of reducing possibility of peeling of a recording material on a recorded surface and of re-deposition thereof onto the recording sheet and capable of satisfactorily inverting the recording sheet thereby obtaining a satisfactory recording result.

Another object of the present invention is to provide a both-side recording apparatus provided with a recording unit for recording on a recording sheet, and a sheet inverting unit for receiving the recording sheet conveyed from the recording unit and returning it to the recording unit after top-back side inversion, and adapted, after recording on a surface of the recording sheet in the recording unit, to invert the recording sheet in the sheet inversion unit and to return the recording sheet to the recording unit for recording on the opposite side of the recording sheet, wherein the sheet inversion unit inverts the recording sheet by conveying along a predetermined conveying path and returns the recording sheet to the recording unit, and is provided, in the conveying path, with a drive roller at a side coming into contact with a recorded surface of the recording sheet conveyed after the recording on a surface in the recording unit and with an idler roller at a side coming into contact with a non-recorded surface of the recording sheet.

Another object of the present invention is to provide a both-side recording apparatus provided with a recording unit for recording on a recording sheet, and a sheet inverting unit for receiving the recording sheet conveyed from the recording unit and returning it to the recording unit after top-back side inversion, and adapted, after recording on a surface of the recording sheet in the recording unit, to invert the recording sheet in the sheet inversion unit and to return the recording sheet to the recording unit for recording on the opposite side of the recording sheet, wherein the sheet inversion unit inverts the recording sheet by conveying along a predetermined conveying path and returns the recording sheet to the recording unit, and is provided, in the conveying path, with a roller of an elastic member at a side coming into contact with a recorded surface of the recording sheet conveyed after the recording on a surface in the recording unit and with a roller of a non-elastic member at a side coming into contact with a non-recorded surface of the recording sheet.

DETAILED DESCRIPTION OF THE PREFERRED EMBODIMENTS

In the following, the embodiments of the present invention will be explained with reference to accompanying drawings.

Figure 1:
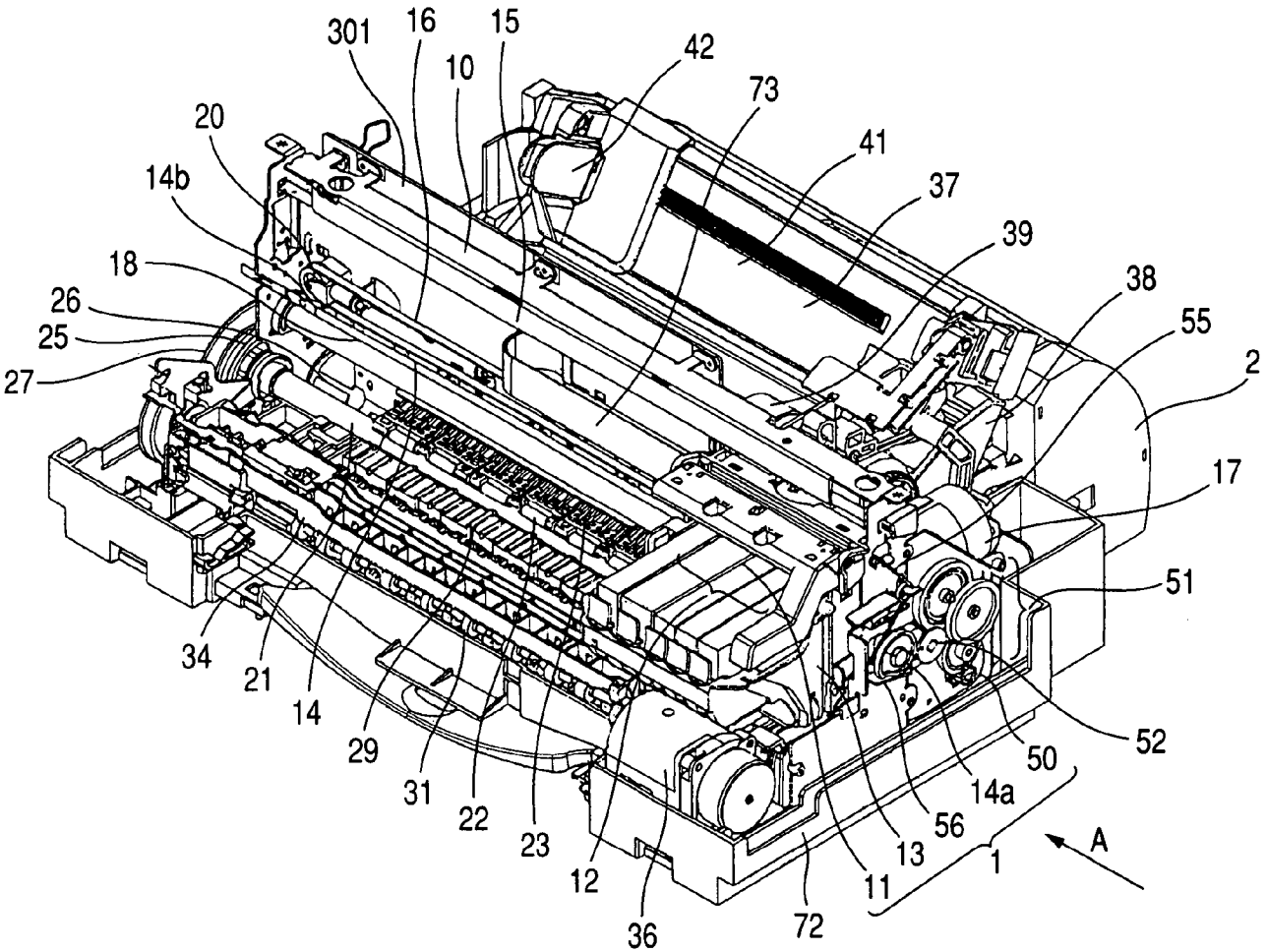
FIG. 1 is a schematic perspective view showing an entire configuration of a recording apparatus constituting an embodiment of the present invention.
Figure 2:
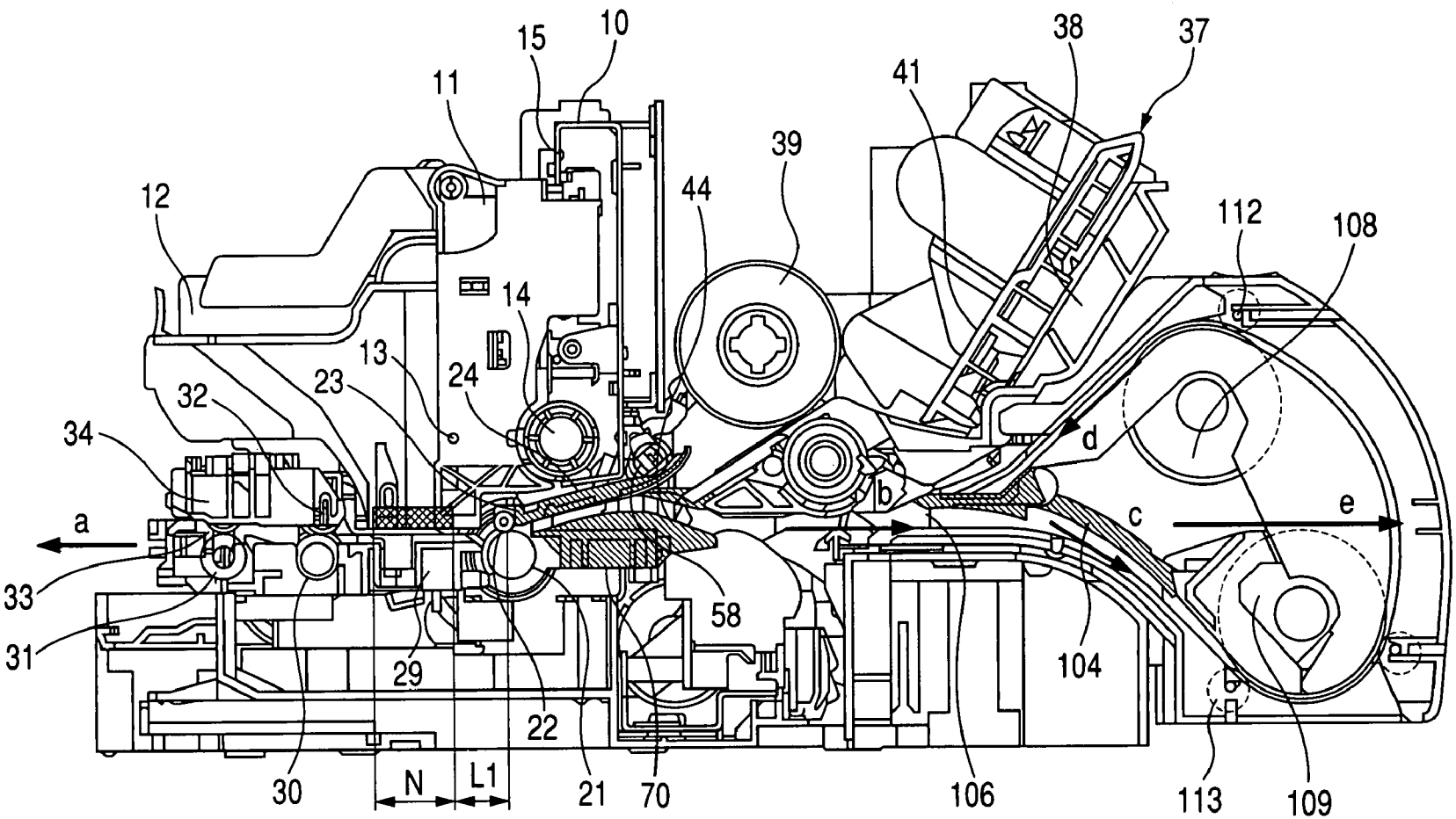
FIG. 2 is a schematic lateral cross-sectional view showing an entire configuration of the recording apparatus constituting an embodiment of the present invention.

FIGS. 1 and 2 are schematic views showing an entire configuration of an embodiment of the recording apparatus of the present invention, in which FIG. 1 is a perspective view and FIG. 2 is a lateral cross-sectional view seen from a direction A in FIG. 1.

Referring to FIGS. 1 and 2, there are shown a main body 1 of a recording unit, a chassis 10 supporting the structure of the recording unit main body 1, an auto both-side unit 2, a maintenance unit 36 to be used for preventing clogging of a recording head 11 or at a replacement of the ink tank 12, and a main ASF 37 for stacking recording sheets and supplying the recording sheet one by one at a recording operation.

There are also shown a recording head 11 for executing recording by ink discharge, an ink tank 12 storing ink to be supplied to the recording head 11, a carriage 13 for supporting the recording head 11 and the ink tank 12 and executing a scanning motion, a guide shaft 14 for supporting the carriage 13, a guide rail 15 provided parallel to the guide shaft 14, and supporting the carriage 13 in cooperation with the guide shaft 14, a carriage belt 16 for driving the carriage 13, a carriage motor 17 for driving the carriage belt 16 by a pulley, a code strip 18 for detecting a position of the carriage 13, and an idler pulley 20 positioned in an opposed relationship to the pulley of the carriage motor 17 for supporting the carriage belt 16 under a tension.

There are also shown a sheet conveying roller 21 for conveying a recording sheet, a pinch roller 22 pressed to and driven by the sheet conveying roller 21, a pinch roller holder 23 for rotatably supporting the pinch roller 22, a pinch roller spring 24 for pressing the pinch roller 22 to the sheet conveying roller 21, a sheet conveying roller pulley 25 fixed to the sheet conveying roller 21, an LF motor 26 for driving the sheet conveying roller 21, and a code wheel 27 for detecting a rotation angle of the sheet conveying roller 21.

There are further provided a platen 29 for supporting the recording sheet in an opposed relation to the recording head 11, a first sheet discharge roller 30 for conveying the recording medium in cooperation with the sheet conveying roller 21, a second sheet discharge roller 31 provided at a downstream side of the first sheet discharge roller 30, a first spur train 32 for supporting the recording sheet in an opposed relation to the first sheet discharge roller 30, a second spur train 33 for supporting the recording sheet in an opposed relation to the second sheet discharge roller 31, and a spur base 34 for rotatably supporting the first spur train 32 and the second spur train 33.

There are also shown an ASF base 38 constituting a base of the main ASF 37, a sheet feeding roller 39 maintained in contact with the recording sheet for feeding thereof, a separation roller 40 for separating recording sheets one by one in case they are simultaneously fed, a pressure plate 41 for stacking the recording sheets and biasing them toward the sheet feeding roller 39, a side guide 42 provided on the pressure plate 41 and fixable in an arbitrary position according to a width of the recording sheet, and an ASF flap 44 for limiting a sheet passing direction of the recording sheet from the main ASF 37 to a single direction. The main ASF 37 is also provided with an unillustrated returning claw for returning, to predetermined position, a front end of a recording sheet which is advanced beyond a nip portion of the sheet feeding roller 39 and the separation roller 40 at a sheet feeding operation.

There are further shown a lift cam shaft 58 for lifting the pin roller holder 23 etc., a lift input gear 50 meshing with an ASF planet gear 49 (cf. FIG. 9 etc.), a lift reducing gear train 51 for transmitting under reduction a power of the lift input gear 50, a lift cam gear 52 connected directly to a lift cam shaft 58 (cf. FIG. 3 etc.), a guide shaft spring 55 for biasing the guide shaft 14 toward a direction (downward), and a guide slope face 56 on which a guide shaft cam R14*a* or a guide shaft cam L14*a* mounted on the guide shaft 14 slides.

There are further shown a sheet guide 70 for guiding the front end of the recording sheet to the nip portion between the sheet conveying roller 21 and the pinch roller 22, a base 72 for supporting the entire recording unit 1, and a control board 301 constituting a control unit.

Figure 21:
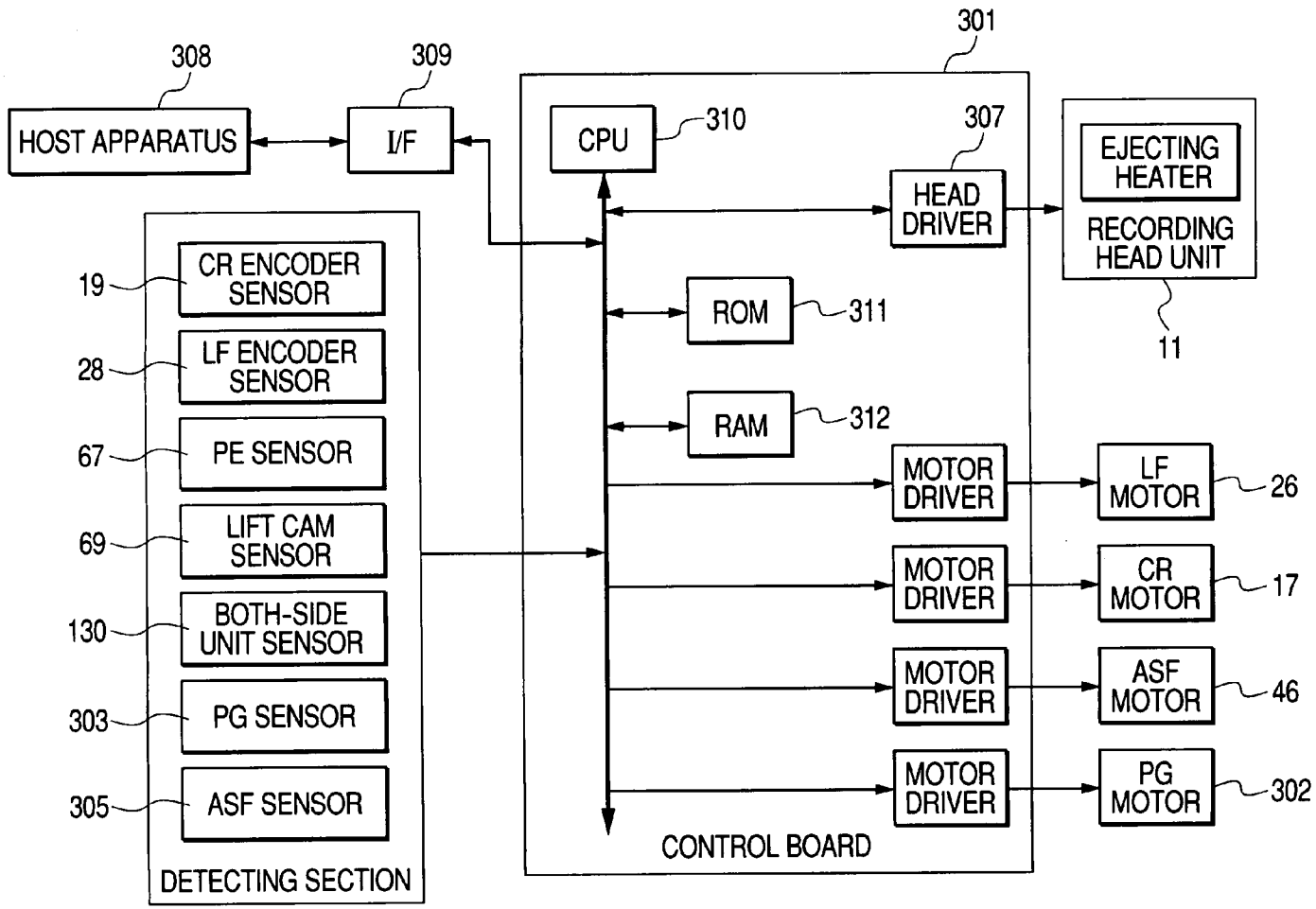
FIG. 21 is a schematic block diagram showing a control unit configuration of a recording apparatus in an embodiment of the present invention.

FIG. 21 is a block diagram showing control means for driving the entire recording apparatus in which the present invention is applied.

Referring to FIG. 21, a CPU 310 controls the present recording apparatus. Based on control data and control programs recorded in a ROM 311, the CPU 310 develops recording data in a RAM 312 and executes predetermined processes thereby outputting control commands to various units. The operation units controlled by the CPU 310 include the recording head 11, an ASF motor 46 for driving the main ASF 37, a PG motor 302 for driving the maintenance unit 36, an LF motor 26, a CR motor 17, etc., and the recording head 11 is driven through a head driver 307 while each motor is driven through a motor driver.

In the present embodiment, the CPU 310 is electrically connected, through an I/F 309, with a host apparatus 308 and is capable of image recording by receiving recording data therefrom.

The CPU 310 is also connected to detection units for detecting states of various units of the recording apparatus. The detection units include a CR encoder sensor 19 mounted on the carriage 13 for reading the code strip 18, an LF encoder sensor 28 mounted on the chassis 10 for reading the code wheel 27, a PG sensor 303 for detecting the function of the maintenance unit 36, an ASF sensor 305 for detecting function of the main ASF 37, a PE sensor 67 for detecting the function of a PE sensor lever 66 (cf. FIG. 3 etc.), a lift cam sensor 69 for detecting the function of the lift cam shaft 58, and a both-side unit sensor 130 for detecting a mounted or detached state of the auto both-side unit 2.

The recording apparatus of the present embodiment is a recording apparatus of general serial scanning type, principally constituted of a sheet feeding unit, a sheet conveying unit, a recording unit, a recording head maintenance unit and an auto both-side unit.

The sheet feeding unit is formed by the main ASF (auto sheet feeder) 37, for extracting one by one the plural recording sheets (not shown) stacked on the pressure plate 41, for supply to the sheet conveying unit. The sheet conveying unit is provided with rollers for pinching and conveying the recording sheet such as the sheet conveying roller 21 and the pinch roller 22, and serves to convey the recording sheet, fed from the sheet feeding unit, through a recording area in which recording is executed by the recording unit.

The recording unit is principally composed of the recording heat 11, and the carriage 13 supporting the recording head 11 and executing a scanning in a direction perpendicular to the conveying direction of the recording sheet. The carriage 13 is guided and supported by the guide shaft 14 and the guide rail 15 which constitutes a part of the chassis 10, and is reciprocated by the transmission of a driving force of the carriage motor 17 through the carriage belt 16, supported under tension between the carriage motor 17 and the idler pulley 20. The recording head 11 is provided with plural ink flow paths connected to the ink tank 12, and the ink flow paths communicate with discharge ports provided on a face opposed to the platen 29. In the vicinity of the discharge port array, an actuator for ink discharge is provided in each discharge nozzle. For such actuator, there is employed, for example, one utilizing a film boiling pressure of liquid by an electrothermal converting member or an electromechanical converting member (piezoelectric member) such as a piezo element.

The recording head maintenance unit is formed by the maintenance unit 36 and serves to prevent clogging of the discharge ports of the recording head 11, to eliminate a smear, for example by paper dusts of the recording head 11, and to suck the ink at the replacement of the ink tank 12. For such purpose, the maintenance unit 36 is provided in a position opposed to the recording head 11 in a waiting position of the carriage 13, and is provided with a cap (not shown) for contacting the discharge nozzle face of the recording head 11 for protecting the discharge nozzles, a wiper (not shown) for wiping the ink discharge nozzle face, a pump (not shown) connected to the cap and generating a negative pressure in the cap. In case of an ink suction from the discharge nozzles of the recording head 11, the cap is pressed to the discharge nozzles face of the recording head 11 and the suction pump is activated to generate a negative pressure in the cap, thereby sucking the ink. Also there is provided a mechanism of contacting the wiper with the discharge nozzle face and moving the wiper parallel thereto, for removing the ink deposited on the discharge nozzle face after the ink suction or a foreign substance such as paper dusts deposited on the discharge nozzle face.

The auto both-side unit 2 in the present embodiment is constituted detachable to the main body of the recording unit 1 constituted of the aforementioned units, and, in case of a both-side recording, serves to receive a recording sheet conveyed by the sheet conveying unit from the recording unit, to convey the recording sheet along a predetermined conveying path thereby inverting the recording sheet and to return it to the recording unit.

In the foregoing, there has been outlined the configuration of the recording apparatus of the present embodiment. In the following there will be explained a one-side recording operation by the recording apparatus of the present embodiment.

At first, when recording data are transferred from the host apparatus 308 through the I/F 309, the recording data are stored in the RAM 312 and the CPU 310 issues a recording operation start command to initiate a recording operation.

When a recording operation is initiated, a sheet feeding operation is executed in the sheet feeding unit. At the start of the sheet feeding operation, the ASF motor 46 rotates in a forward direction to rotate a cam supporting the pressure plate 41 through a gear train. When the cam is detached by the rotation, the pressure plate 41 is biased, by the function of an unillustrated pressure plate spring, toward the sheet feeding roller 39. At the same time, the sheet feeding roller 39 rotates in a conveying direction of the recording sheet, thereby starting the conveying of an uppermost recording sheet.

In this operation, plural recording sheets may be advanced at the same time depending on conditions of a frictional force between the paper feeding roller 39 and the recording sheet and of a mutual frictional force between the recording sheets. In such situation, the separation roller 40 maintained in contact with the sheet feeding roller 39 and having a predetermined inverse rotation torque in a direction opposite to the conveying direction of the recording sheet serves to push back the recording sheet onto the pressure plate 41 other than the recording sheet closest to the side of the sheet feeding roller 39.

At the end of the sheet feeding operation by the ASF, the separation roller 40 is released from the contact state with the sheet feeding roller 39 and is separated therefrom by a predetermined distance by a cam function, and, in this state, the unillustrated returning claw is rotated to perform its function of securely returning the recording sheet onto the predetermined position on the pressure plate 41.

Through the aforementioned operations, only one recording sheet is conveyed to the sheet conveying unit.

When the one recording sheet is conveyed from the main ASF 37, the front edge of the recording sheet comes into contact with the ASF flap 44 biased by the ASF flap spring in a direction to block the sheet path, but the front edge passes by pushing back the ASF flap 44. When the recording operation on the recording sheet is completed and the rear edge of the recording sheet passes the ASF flap 44, the ASF flap 44 returns to the original biased state to close the sheet path, whereby the recording sheet does not return to the side of the main ASF 37 when conveyed in the reverse direction.

The recording sheet conveyed from the sheet feeding unit is conveyed to the nip portion of the sheet conveying roller 21 and the pinch roller 22, constituting the sheet conveying unit. The center of the pinch roller 22 is mounted with a certain offset, with respect to the center of the sheet conveying roller 21, in a direction closer to the first sheet discharge roller 30, whereby a tangential direction along which the recording sheet is inserted is somewhat inclined from the horizontal direction. Therefore, in order that the front edge of the sheet can be securely guided to the nip portion, a sheet path formed by the pinch roller holder 23 and the guide member 70 is inclined downwards toward the nip portion.

The sheet conveyed by the ASF 37 impinges on the nip portion of the sheet conveying roller 21 which is in a stopped state. In this operation, the main ASF 37 executes a conveying of a distance somewhat longer than the predetermined sheet path length, whereby the recording sheet is bent between the sheet feeding roller 39 and the sheet conveying roller 21, thus forming a loop. A returning force is therefore generated to turn the loop to a straight state to push the front edge of the sheet toward the nip portion of the sheet conveying roller 21. Thus the front edge of the sheet is aligned parallel to the sheet conveying roller 21, thereby achieving so-called registration operation.

After such registration operation, the rotation of the LF motor 26 is initiated in a normal advancing direction of the recording sheet (direction advancing toward the first sheet discharge roller 30). Thereafter the sheet feeding roller 39 is cut off from the driving power and is rotated by the movement of the recording material. At this point, the recording sheet is conveyed only by the sheet conveying roller 21 and the pinch roller 22. The recording sheet is advanced in the normal direction by a predetermined line feed amount, and proceeds along a rib provided on the platen 29. The front edge of the recording sheet reaches in succession a nip portion between the first sheet discharge roller 30 and the first spur train 32 and a nip portion between the second sheet discharge roller 31 and the second spur train 33. Since the sheet conveying roller 21, the first sheet discharge roller 30 and the second sheet discharge roller 32 are connected through a gear train, which is so constructed that the first sheet discharge roller 30 and the second sheet discharge roller 31 have peripheral speeds substantially equal to that of the sheet conveying roller 21, the first sheet discharge roller 30 and the second sheet discharge roller 31 rotate in synchronization with the sheet conveying roller 21, whereby the recording sheet is conveyed without a slack or a tension.

In synchronization with the conveying of the recording sheet, a recording onto the recording sheet is executed by the recording unit. In such recording operation, the carriage 13 is moved, by the CR motor 17, in a direction crossing the conveying direction of the recording sheet, and a signal from a head driver 307 is transmitted to the recording head 11 through a flexible flat cable 73 thereby discharging an ink droplet according to the recording data. Also the code strip 18 provided in the chassis 10 is read by the CR (carriage) encoder 19 mounted on the carriage 13 to enable ink droplet discharge toward the recording sheet at a suitable timing. After the recording of a line in this manner, the recording sheet is conveyed by a necessary amount by the sheet conveying unit. This operation is executed repeatedly to achieve a recording operation over the entire surface of the recording sheet.

In the following there will be given a detailed description on the configuration for inverting the recording sheet for executing a both-side recording, including a configuration of the auto both-side unit 2. A feature of the recording apparatus of the present embodiment is the ability of executing so-called auto both-side recording, for automatically recording a front side and a back side of a separated sheet without requiring an operation of an operator.

At first reference is made to FIG. 2 for explaining the path passed by the recording sheet.

In FIG. 2, the auto both-side unit 2 is provided with a switchable flap 104 formed by a movable flap rotatably supported and determining a passing direction of the recording sheet, an exit flap 106 rotatably supported and to be opened and closed when the recording sheet goes out of the both-side unit 2, a both-side roller A 108 for conveying the recording sheet in the both-side unit 2, a similar both-side roller B 109, a both-side pinch roller A 113 moving with the both-side roller A 108, and a both-side pinch roller B 112 moving with the both-side roller B 109.

When a recording operation is initiated, the sheet feeding roller 39 serves to feed the recording sheet one by one to the sheet conveying roller 21 from the plural recording sheets stacked on the main ASF 37. The recording sheet pinched between the sheet conveying roller 21 and the pinch roller 22 is conveyed in a direction indicated by an arrow a in FIG. 2.

In case of executing a both-side recording, after the recording on the front (top) surface, the recording sheet is conveyed in a horizontal path provided below the main ASF 37 in a direction indicated by an arrow b in FIG. 2, namely toward the auto both-side unit 2 positioned behind the main ASF 37. The recording sheet is guided from the horizontal path into the auto both-side unit 2 and is conveyed inclinedly downward along a flap 104, in a direction indicated by an arrow c in FIG. 2.

Then the recording sheet changes the advancing direction thereof upward by being pinched between the both-side roller B 109 and the both-side pinch roller B 112, further along a rear cover 103 (cf. FIG. 13) toward the recording unit and reaches a nip portion of the both-side roller A 108 and the both-side pinch roller A 113. Then the recording sheet pinched, between the both-side roller A 108 and the both-side pinch roller A 113 is conveyed along the both-side roller A 108 inclinedly downward as indicated by an arrow d in FIG. 2. In this manner the recording sheet is conveyed along a turn-around path with a change of the advancing direction by 180° finally, and is returned to the horizontal path. Thereafter the recording sheet conveyed in the horizontal path in a direction indicated by an arrow a in FIG. 2 is again pinched by the paper conveying roller 21 and the pinch roller 22, for executing recording on the rear surface.

As explained above, the recording sheet after the recording on the front side is conveyed along the horizontal path below the main ASF 37, conveyed to the auto both-side unit 2 behind the main ASF 37 and is subjected to a front-back side inversion and is returned to the sheet conveying roller 21. Thereafter a conveying by the sheet conveying unit and a recording operation by the recording unit in synchronization with the conveying are executed again to achieve recording on the back side, whereby, in this configuration, the recordings on the front and back sides, namely two-side recording, are automatically executed.

A recording range on the front side will be explained. The recording head 11 is provided with a discharge port area (recording area, ink discharge area) N between the paper conveying roller 21 and the first sheet discharge roller 30, but, because of conditions of arrangement of the ink flow paths to the discharge ports and of wirings to the ink discharging actuators, it is usually difficult to position the discharge port area N in the immediate vicinity of the nip portion of the sheet conveying roller 21. On this account, as shown in FIG. 2, the discharge port area N is positioned downward by a length L1 from the nip portion of the sheet conveying roller 21. Therefore, in a state where the recording sheet is pinched between the sheet conveying roller 21 and the pinch roller 22, the recording cannot be made within a range of the length L1, at the side of the nip portion of the sheet conveying roller 21.

In order to reduce such lower end margin of the front side, the recording apparatus of the present embodiment executes the recording up to a portion where the recording sheet is released from the nip portion of the sheet conveying roller 21 and is pinched and conveyed by the first sheet discharge roller 30 and the second sheet discharge roller 31 only. In this manner the recording operation is rendered possible until the lower end margin on the front side becomes zero.

However, in case of conveying the recording sheet from this state in the aforementioned direction b in FIG. 2, it is not possible to guide the recording sheet to the nip portion of the sheet conveying roller 21 and the pinch roller 22 and there may result so-called sheet jam. In the present embodiment, in order to avoid such sheet jam, means to be explained in the following is used for releasing (separating) the pinch roller 22 from the sheet conveying roller 21 thereby forming a predetermined gap, and, after an end portion of the recording sheet is drawn into such gap, the pinch roller 22 is brought into contact again with the sheet conveying roller 21, thereby enabling conveying of the recording sheet in the direction b shown in FIG. 2.

In the following, there will be explained a release mechanism for the pinch roller 22, a release mechanism for the PE sensor lever 66, a pressure regulating mechanism for the pinch roller spring 24, a vertical movement mechanism for the sheet guide 70, and a vertical movement mechanism for the carriage 13, which constitute features of the recording apparatus of the present embodiment.

The pinch roller 22 is released from the sheet conveying roller 21 in order to re-introduce the recording sheet as explained in the foregoing. The recording apparatus of the present embodiment are provided with certain mechanisms principally for achieving satisfactory conveying of the recording sheet in the reverse direction, for inverting the top and back sides of the recording sheet after the re-introduction thereof.

One of such mechanisms is a release mechanism for the PE sensor lever 66. The PE sensor lever 66 is so mounted as to be capable of rocking between a position protruding into the conveying path of the recording sheet and a position retracted from the conveying path, and detects a position of the recording sheet by a rocking of the PE sensor lever by an engagement with the conveyed recording sheet. Such PE sensor lever 66 is usually mounted with a certain angle of the surface of the recording sheet, in the position protruding in the conveying path of the recording sheet, in order to exactly detect the position of the front edge or the rear edge of the recording sheet when it proceeds in the normal direction. Because of such setting, in case the sheet proceeds in the reverse direction, there is encountered technical difficulties that an end portion of the recording sheet is hooked or an end of the PE sensor lever 66 engages with the recording sheet under conveying. In the present embodiment, therefore, the PE sensor lever 66 is released from the passing sheet surface until a middle of the front-back side inversion step of the recording sheet so as not to be in contact with the recording sheet.

The aforementioned release mechanism for the PE sensor lever 66 is not essential but may be replaced by another means or configuration. For example, for resolving the aforementioned technical difficulties, it is possible to provide the front end of the PE sensor lever 66 with a roller or the like, thereby resolving the technical difficulties by the rotation of such roller when the recording sheet advances in the opposite direction. It is also possible to adopt a configuration in which the PE sensor lever 66 has a larger rocking angle and can swing to an angle opposite to the direction opposite to the normal when the recording sheet is conveyed in the opposite direction, thereby resolving the aforementioned technical difficulties.

Another mechanism is a pressure regulating mechanism for the pinch roller spring 24. In the present embodiment, the pinch roller 22 is released by rotating the entire pinch roller holder 23. In a state where the pinch roller 22 is pressed to the sheet conveying roller 21, since the pinch roller holder 23 is pressed by the pinch roller spring 24, a rotation of the pinch roller holder 23 in the releasing direction increases the pressure of the pinch roller spring 24 thereby resulting in drawbacks of an increase in the load for releasing the pinch roller holder 23 or an increase in the stress applied to the pinch roller holder 23 itself. In order to prevent such phenomenon, a mechanism for reducing the pressure of the pinch roller spring 24 at the release of the pinch roller holder 23 is provided.

Another mechanism is a vertical movement mechanism for the sheet guide. The sheet guide 70 is usually provided, in order to guide the recording sheet supplied from the main ASF 37 to the sheet conveying roller 21, in a position at an upward angle with respect to the horizontal path (state shown in FIG. 2), so as to smoothly guide the recording sheet to the nip portion of the LF roller 21 having a certain angle from the horizontal position as explained in the foregoing. In such configuration, however, when the recording sheet is conveyed in the direction of the arrow b in FIG. 2, the recording sheet is again guided to the main ASF 37. In order to prevent such situation and to enable a smooth guiding to the horizontal path, it is preferable to change the angle of the sheet guide 70 to a horizontal position. For this purpose, a vertical movement mechanism for vertically moving the sheet guide 70 is provided.

A final mechanism is a vertical movement mechanism for the carriage 13. When the pinch roller holder 23 is brought into the released state, the front end of the pinch roller holder 23 comes close to the carriage 13, and this mechanism is preferably provided in order to prevent the mutual contact of the two, thereby avoiding a situation of hindering the movement of the carriage 13 in the main scanning direction. Therefore a vertical movement mechanism is provided for elevating the carriage 13 in synchronization with the releasing operation of the pinch roller holder 23. This vertical movement mechanism for the carriage 13 can also be utilized for other purposes, for example in case of retracting the recording head 11 in order to prevent contact of the recording head 11 and the recording sheet in case of recording a thick recording sheet.

In the following detailed explanations will be given on the foregoing five mechanisms.

Figure 3:
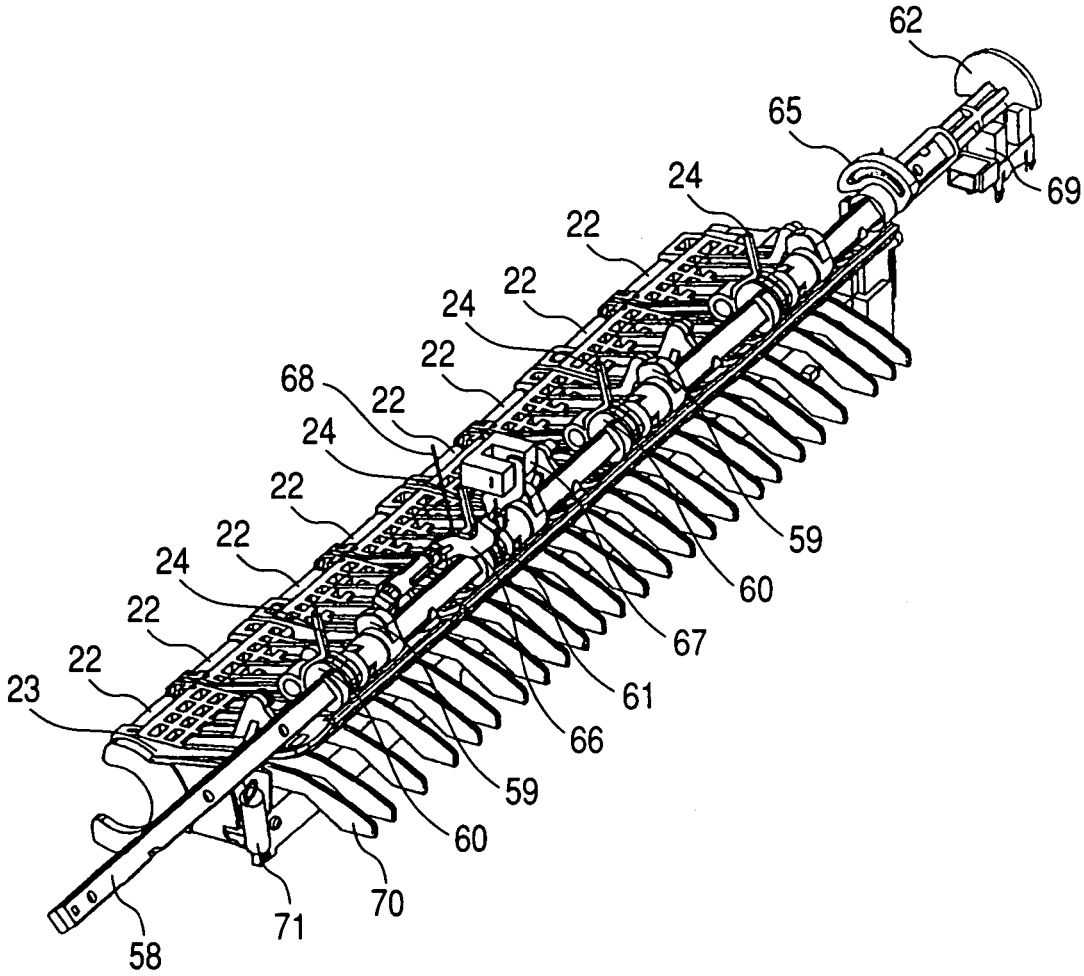
FIG. 3 is a schematic perspective view showing a pinch roller contact-separation mechanism in a recording apparatus of an embodiment of the present invention.

FIG. 3 is a schematic perspective view showing the configuration of the pinch roller release mechanism, the PE sensor lever release mechanism, the pinch roller spring pressure regulating mechanism and the sheet guide vertical movement mechanism.

In FIG. 3, there are shown a pinch roller holder pressing cam 59 in contact with the pinch roller holder 23, a pinch roller spring pressing cam 60 acting on the pinch roller spring 24, a PE sensor lever pressing cam 61 in contact with the PE sensor lever 66, a sheet guide pressuring cam 65 in contact with the sheet guide 70, a lift cam shaft shield plate 62 for detecting an angle of the lift cam shaft 58, a lift cam sensor 69 to be exposed/masked by the lift cam shaft shield plate 62, a PE sensor lever 66 for detecting to be in contact with the conveyed recording sheet for detecting the front edge or the rear end thereof, a PE sensor 67 to be exposed/masked by the PE sensor lever 66, a PE sensor lever spring 68 for biasing the PE sensor lever 66 in a predetermined direction, and a sheet guide spring 71 for biasing the sheet guide 70 in a predetermined direction.

The pinch roller release mechanism, the PE sensor lever release mechanism, the pinch roller spring pressure regulating mechanism and the sheet guide vertical movement mechanism are operated by a rotation of the lift cam shaft 58. In the configuration of the present embodiment, the pinch roller holder pressing cam 59, the pinch roller spring pressing cam 60, the PE sensor lever pressing cam 61 and the sheet guide pressing cam 65 are respectively fixed on the lift cam shaft 58, whereby the respective cams function in synchronization with a turn of the lift cam shaft 58. An initial angle and a turn of the lift cam shaft 58 are recognized by the shift to the exposed or permeated state or masked or blocked state of the lift cam sensor 69 by means of the lift cam shaft shield plate 62. The concept of the present invention is not limited by such configuration, and there may also be employed a mechanism which drives these mechanisms independently.

In the following, function of each mechanism will be explained.

Figure 4A:
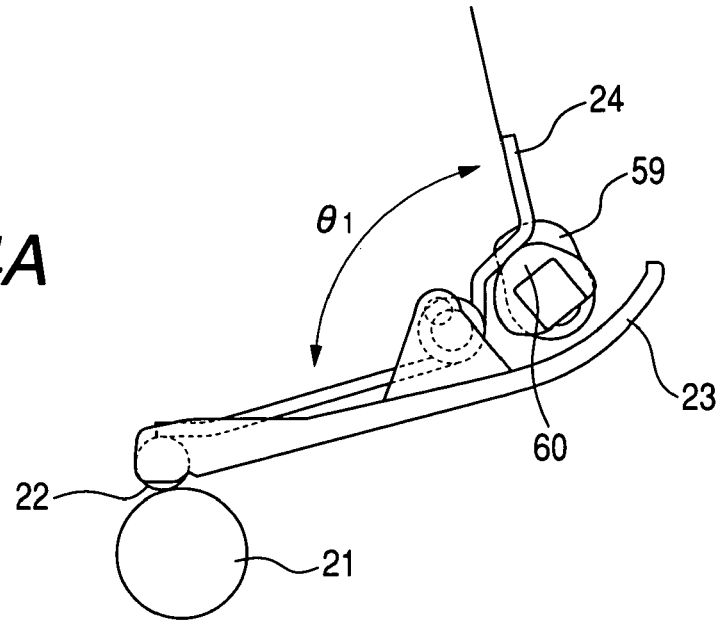
FIGS. 4A, 4B and 4C are schematic lateral cross-sectional views showing a pinch roller contact-separation mechanism in a recording apparatus of an embodiment of the present invention.
Figure 4B:
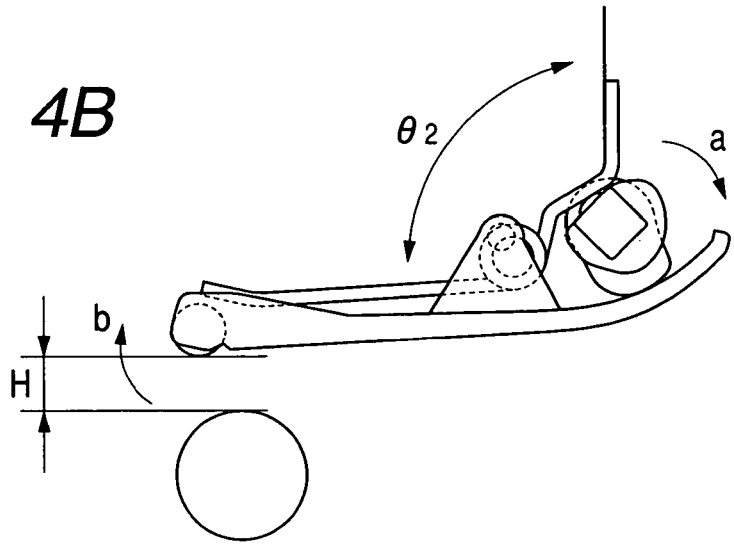
Figure 4C:
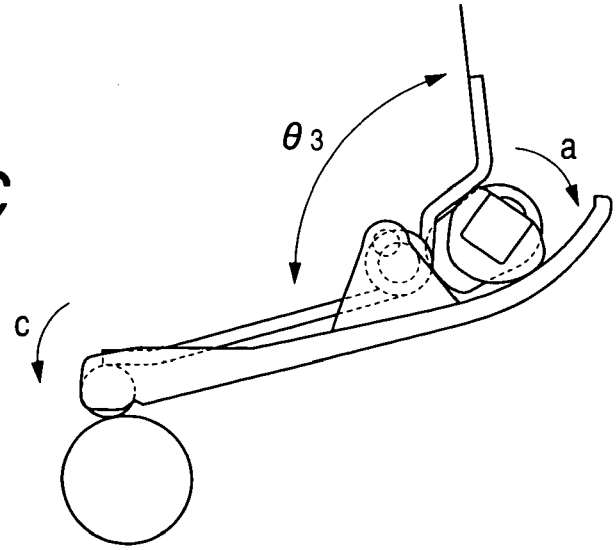

FIGS. 4A, 4B and 4C are partial lateral views schematically showing functions of the pinch roller release mechanism and the pinch roller spring pressure regulating mechanism.

FIG. 4A shows a state where the pinch roller holder pressing cam 59 is in an initial state, and the pinch roller 22 is pressed to the sheet conveying roller 21 under a standard pressure. The pinch roller holder 23 is rotatably supported, at a pinch roller holder shaft 23*a,* by bearings in the chassis 10, and is capable of a rocking motion over a predetermined angular range. The pinch roller holder 23 rotatably supports, at an end thereof, the pinch roller 22 and is provided, at the other end, with an area for impinging on the pinch roller holder pressing cam 60. Also the pinch roller spring 24 is formed by a torsion coil spring, which impinges at an end, as a function point, on the pinch roller holder 23 at a side of the pinch roller 22, is supported at the other end by the pinch roller spring pressing cam 60 and is supported at an intermediate portion of the spring by a support portion of the chassis 10. Owing to such support, the pinch roller 22 is pressed under a predetermined pressure to the sheet conveying roller 21. By activating the rotating mechanism for the sheet conveying roller 21 in this state, it is possible to convey the recording sheet pinched in the nip portion of the sheet conveying roller 21 and the pinch roller 22.

FIG. 4B shows a state where the pinch roller 22 is in a released state, and the pinch roller spring 24 is in a load-removed state. More specifically, by a rotation of the lift cam shaft 58 in a direction indicated by an arrow a in FIGS. 4A to 4C, the pinch roller holder pressing cam 59 impinges on the pinch roller holder 23 to gradually rotate the pinch roller holder 23 in a direction of an arrow b in FIGS. 4A–4C, whereby the pinch roller 22 is released from the sheet conveying roller 21. Also the pinch roller spring pressing cam 60 contacts the pinch roller spring 24 at a smaller radius, whereby a contact point of the pinch roller spring 24 with the pinch roller pressing cam 60 is rotated in a same direction as a rotating direction of a contact point with the pinch roller holder 23 by the rotation of the pinch roller holder 23. Also a torsion angle θ2 of the pinch roller spring 24 is larger in this state than in the state shown in FIG. 4A, whereby the load of the spring is reduced and the pinch roller holder 23 is almost free from the load. Therefore, at the rotation of the pinch roller holder 23, the biasing force of the pinch roller spring 24 does not become a load for the rotation, and the pinch roller holder 23 is in a state almost free from the stress. In this state, a gap H of a predetermined amount is formed between the sheet conveying roller 21 and the pinch roller 22, and the front edge of the recording sheet, even in case of being roughly guided, can be easily inserted into the nip portion.

FIG. 4C shows a state where the pinch roller 22 is pressed to the sheet conveying roller 21 as in FIG. 4A, but in a light contact state with a weaker contact pressure. From the state shown in FIG. 4B, a further rotation of the lift cam shaft 58 in the direction of the arrow a in FIGS. 4A, 4B and 4C releases the contact between the pinch roller holder pressing cam 59 and the pinch roller holder 23, the pinch roller holder 23 rotates in a direction of an arrow c in FIGS. 4A, 4B and 4C to return to the original state, and the pinch roller spring pressing cam 60 contacts the pinch roller spring 24 with such a radius between those in FIGS. 4A and 4B. Thus, the torsion angle θ3 of the pinch roller spring 24 is somewhat smaller than in the state in FIG. 4A, so that the contact force of the pinch roller 22 to the sheet conveying roller 21 becomes somewhat smaller than in the state in FIG. 4A. In such configuration, in case a recording sheet thicker than normal is pinched between the sheet conveying roller 21 and the pinch roller 22, there can be prevented a situation where the torsion angle of the pinch roller spring 24 becomes larger than in the ordinary situation thereby resulting in an excessively large load. It is therefore possible to equalize the rotational load by the axial loss of the sheet conveying roller 21 by switching the state shown in FIG. 4A and the state shown in FIG. 4C according to the thickness of the recording sheet.

When the lift cam shaft 58 is rotated by one turn through the aforementioned states, the mechanism returns to a standard state shown in FIG. 4A.

Figure 5A:
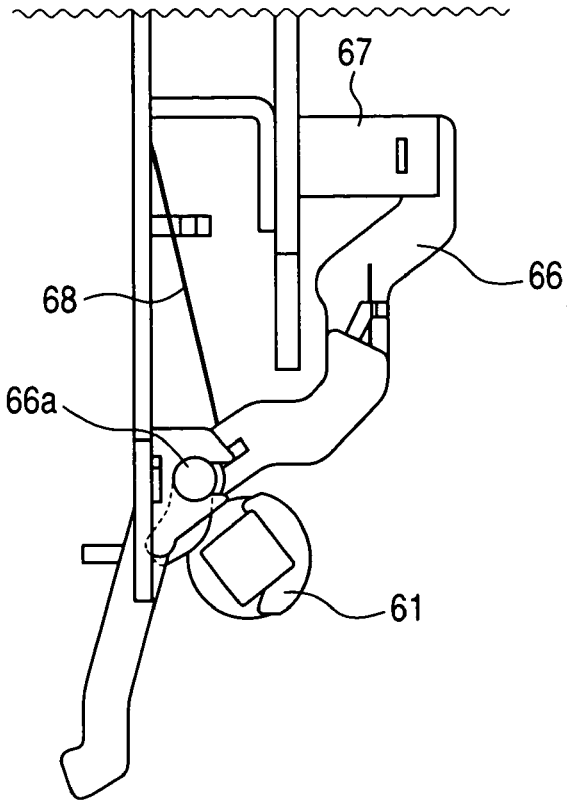
FIGS. 5A and 5B are schematic lateral cross-sectional views showing a PE sensor vertical-movement mechanism in a recording apparatus of an embodiment of the present invention.
Figure 5B:
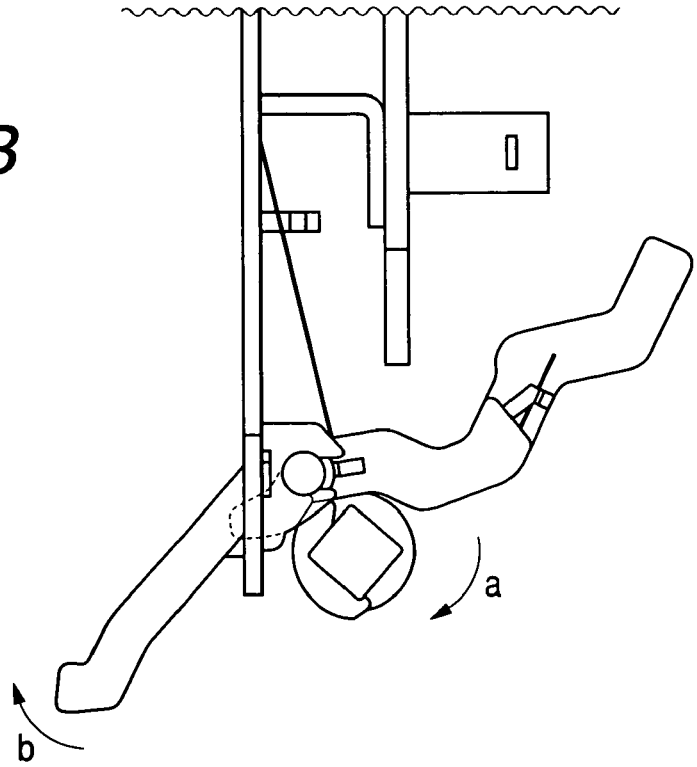

FIGS. 5A and 5B are partial lateral views schematically showing the functions of the PE sensor lever vertical movement mechanism.

FIG. 5A illustrates a state where the PE sensor lever pressing cam 61 is in an initial state and the PE sensor lever 66 is in a free state. The PE sensor lever 66 is rotatably supported, about a PE sensor lever shaft 66a, by bearings in the chassis 10. In this state, the PE sensor lever 66 is biased to the illustrated position by the PE sensor lever spring 68, and the PE sensor 67 is masked or blocked by a shield plate of the PE sensor lever 66. When a recording sheet passes this position in this state, the PE sensor lever 66 rotates clockwise in FIG. 5A, whereby the PE sensor 67 is exposed or permeated thereby being capable of detecting the presence of the recording sheet in the position of the PE sensor lever 66. Such shifts to the masked state and the exposed state allow to detect the front edge and the rear edge of the recording sheet.

FIG. 5B is a partial lateral view schematically showing a state where the PE sensor lever 66 is locked by the PE sensor lever pressing cam 61. More specifically, a rotation of the PE sensor lever pressing cam 61 in the direction of the arrow a in FIGS. 5A and 5B causes a cam follower portion of the PE sensor lever 66 to be pushed up and rotated in a direction indicated by an arrow b. In this state, a sheet detecting portion of the PE sensor lever 66 is hidden inside the pinch roller holder 23, so that the PE sensor lever 66 does not contact the recording sheet even it is present in the path. Therefore, in case the recording sheet is conveyed in the direction of the arrow b in FIG. 2 in this state, the recording sheet can be prevented from jamming by contacting the PE sensor lever 66.

Figure 6A:
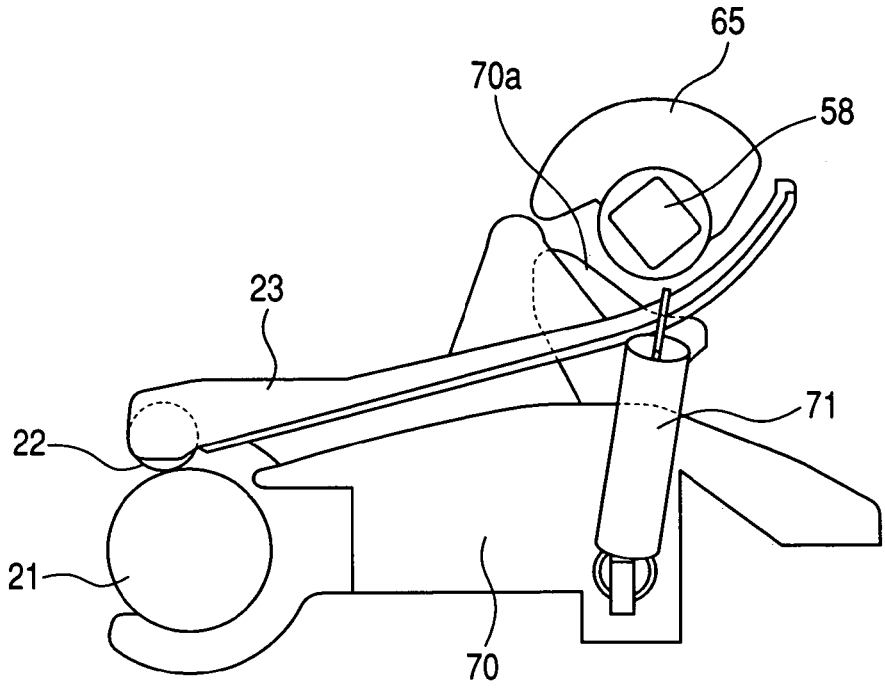
FIGS. 6A and 6B are schematic lateral cross-sectional views showing a sheet guide vertical-movement mechanism in a recording apparatus of an embodiment of the present invention.
Figure 6B:
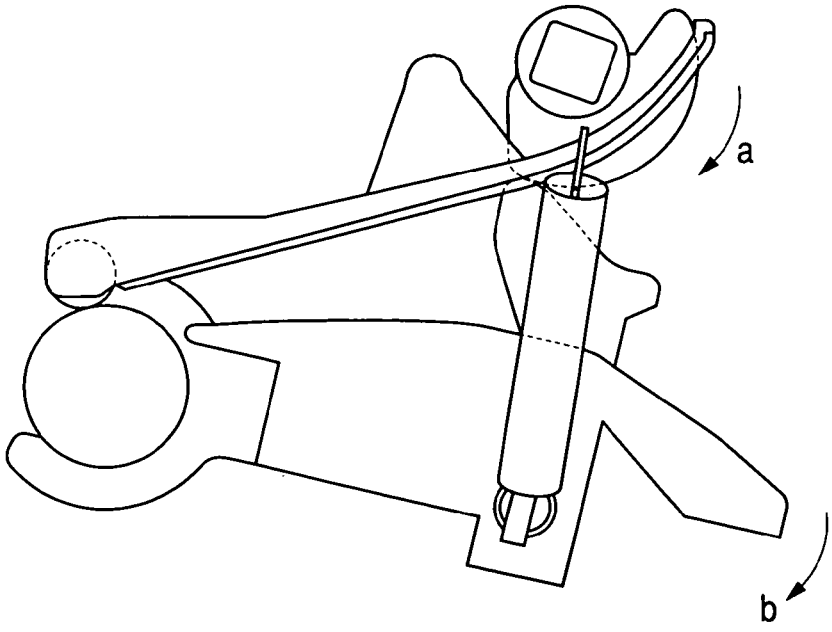

FIGS. 6A and 6B are schematic lateral views showing functions of the sheet guide vertical movement mechanism. FIG. 6A shows a state where the sheet guide 70 is in an up-state. The sheet guide 70 is usually biased in a lifted direction by the sheet guide spring 71, and is defined in position by impinging on an unillustrated stopper. By the function of the sheet guide spring 71, the sheet guide 70 maintains this position when a recording sheet supplied from the main ASF 37 passes. However, the sheet guide 70 can be lowered against the spring force of the sheet guide spring 71 in case a force larger than in the normal state is applied.

FIG. 6B shows a state where the sheet guide 70 is in a down-state. Referring to FIG. 6B, a rotation of the sheet guide pressing cam 65 fixed to the lift cam shaft 58 in a direction of an arrow a in FIGS. 6A and 6B causes the sheet guide pressing cam 65 to impinge on and gradually press a sheet guide cam follower 70*a* which constitutes a part of the sheet guide 70. Thus the sheet guide 70 is rotated in a direction of an arrow b in FIGS. 6A and 6B and is pressed down against the spring force of the sheet guide spring 71. In this state, a portion of the sheet guide 70 facing the sheet path becomes substantially horizontal whereby the sheet path becomes almost completely straight. Thus, when the sheet is conveyed in the direction of the arrow b in FIG. 2 by the sheet conveying roller 21, the recording sheet is conveyed horizontally and an already recorded portion on the surface of the recording sheet is prevented from being pressed to an upper portion of the sheet path.

Figure 7:
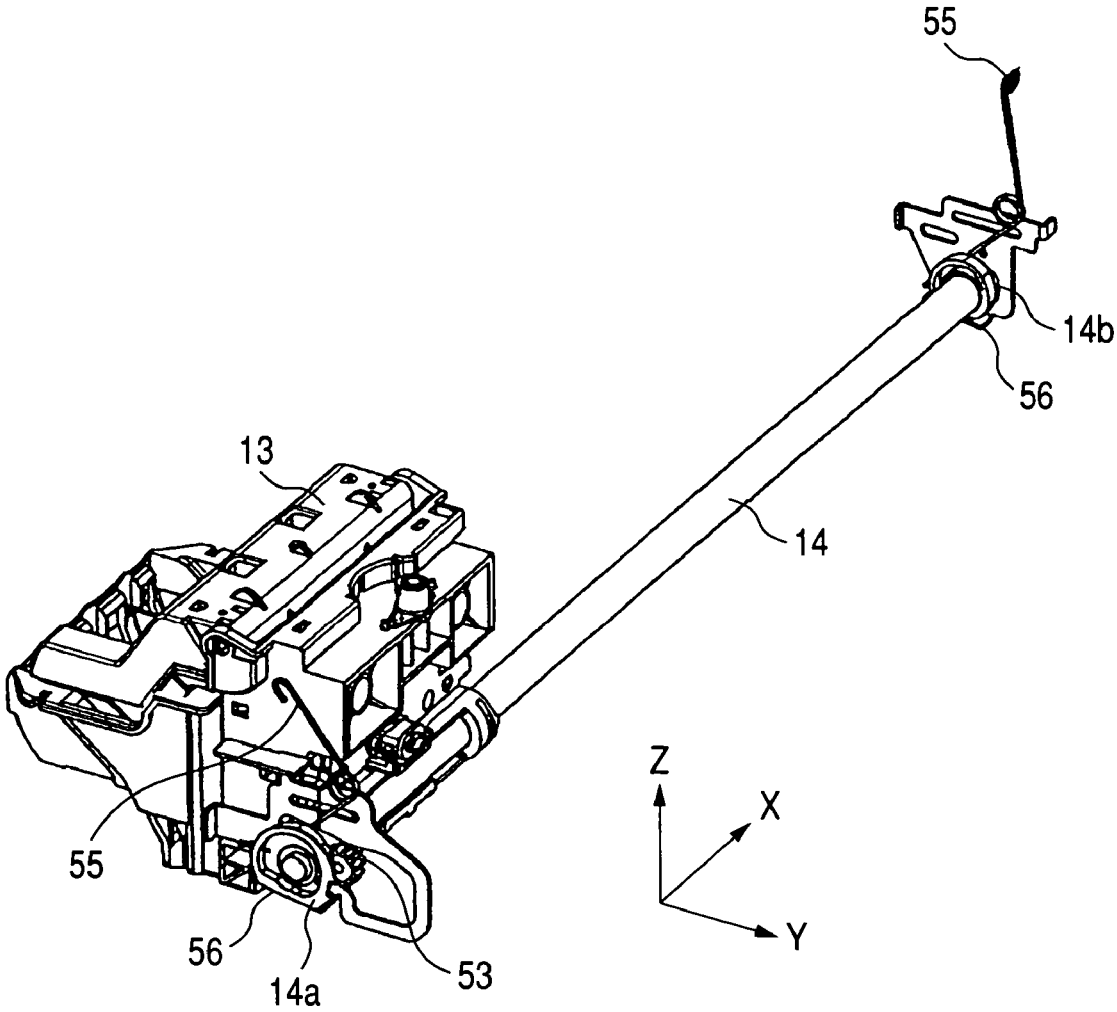
FIG. 7 is a schematic perspective view showing a guide shaft vertical-movement mechanism in a recording apparatus in an embodiment of the present invention.

FIG. 7 is a schematic perspective view showing a carriage vertical movement mechanism.

In FIG. 7, there are shown a guide shaft cam R 14*a* mounted on the guide shaft 14, a guide shaft cam L 14*b* mounted on the guide shaft 14, and a cam idler gear 53 connecting a lift cam gear 52 and a gear integral with the right guide shaft cam R 14*a*.

The guide shaft 14 is supported by both lateral faces of the chassis 10 as shown in FIG. 1, and is fitted in unillustrated vertically elongated holes (cf. FIGS. 8A, 8B and 8C) thereby being freely movable in a direction indicated by an arrow Z in FIG. 7 but being prevented from movement in directions of arrows X and Y in FIG. 7. The guide shaft 14 is normally biased downwards (opposite to the arrow Z) by the guide shaft spring 55, but, when the cam idler gear 53 rotates, the guide shaft cam R 14*a* and the guide shaft cam L 14*b* impinge on the guide slopes 56 whereby the guide shaft 14 itself rotates and moves vertically.

Figure 8A:
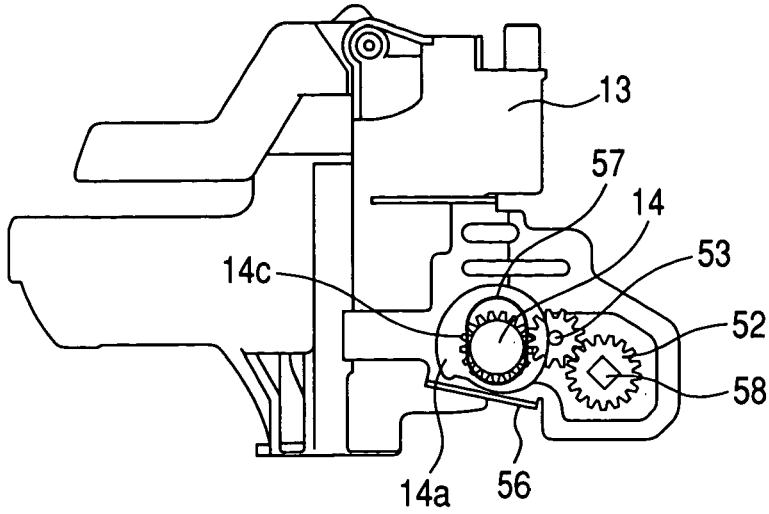
FIGS. 8A, 8B and 8C are schematic lateral cross-sectional views showing a guide shaft vertical-movement mechanism in a recording apparatus of an embodiment of the present invention.
Figure 8B:
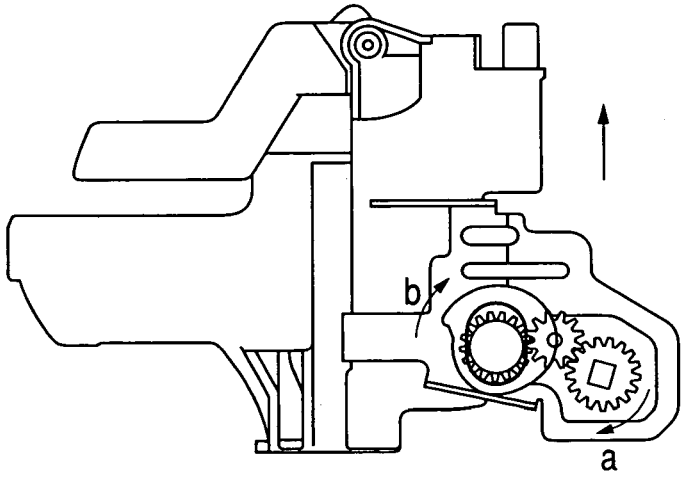
Figure 8C:
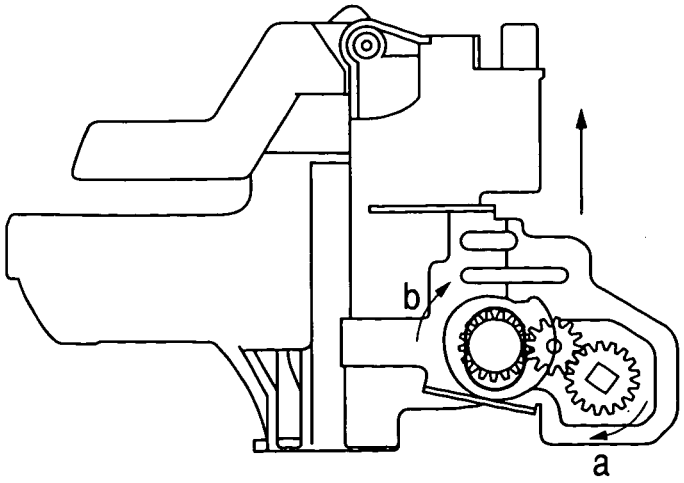

FIGS. 8A to 8C are partial lateral views schematically showing functions of the carriage vertical movement mechanism.

FIG. 8A shows a state where the carriage 13 is in a first carriage position which is a standard position. In this state, the guide shaft 14 is defined in position by impinging on a lower end of the elongated guide hole 57 of the chassis 10, and the guide shaft cam R 14*a* is not in contact with the guide slope 56.

FIG. 8B shows a state where the carriage 13 is moved to a somewhat higher second carriage position. From the first carriage position, a rotation of the lift cam shaft 58 causes the lift cam gear 52, fixed on the lift cam shaft 58, to rotate, whereby the guide shaft cam R gear 14*c* rotates through the cam idler gear 53 meshing with the lift cam gear 52, thereby causing a shift to the second carriage position.

By selecting a same number of teeth for the lift cam gear 52 and the guide shaft cam gear 14*c*, the lift cam shaft 58 and the guide shaft 14 rotate in a same direction by approximately same angles. The rotations are not in a completely same angle, because the lift cam gear 52 and the cam idler gear 53 have fixed rotary axes while the guide shaft 14 itself, constituting a rotary axis of the guide shaft cam gear 14*c*, can move vertically whereby the distance between the gears changes.

Such rotation of the lift cam shaft 58 in the direction of the arrow a in FIGS. 8A, 8B and 8C causes the guide shaft 14 to also rotate in a direction of an arrow b in FIGS. 8A, 8B and 8C. This rotation causes the guide shaft cam R 14*a* and the guide shaft cam L 14*b* to respectively impinge on the guide slope 56 in a fixed position. In this state, since the moving direction of the guide shaft 14 is limited to the vertical direction by the elongated guide hole 57 of the chassis 10 as explained before, the carriage 13 moves vertically above from the first carriage position to the second carriage position. Such shift to the second carriage position is also suitable in case the recording sheet shows a large deformation to cause a contact of the recording sheet and the recording head 11 in the first carriage position.

FIG. 8C shows a state where the carriage 13 is in a highest third carriage position. A further rotation of the lift cam shaft 58 from the second carriage position causes the guide shaft cam R 14*a* and the guide shaft cam L 14*b* to contact the guide slope 56 with portions of larger radii, whereby the carriage 13 is moved to a still higher position. Such third carriage position is suitable also for a recording sheet thicker than normal.

In the foregoing, detailed explanations on the five mechanisms have been given.

In the following, a drive mechanism for the lift cam shaft 58 will be explained.

In the present embodiment, the ASF motor 46 for driving the main ASF 37 is employed as a drive source for the lift cam shaft 58. The ASF motor 46 is controlled in the rotating direction and the rotating amount to suitably operate the main ASF 37 or the lift cam shaft 58.

Figure 9:
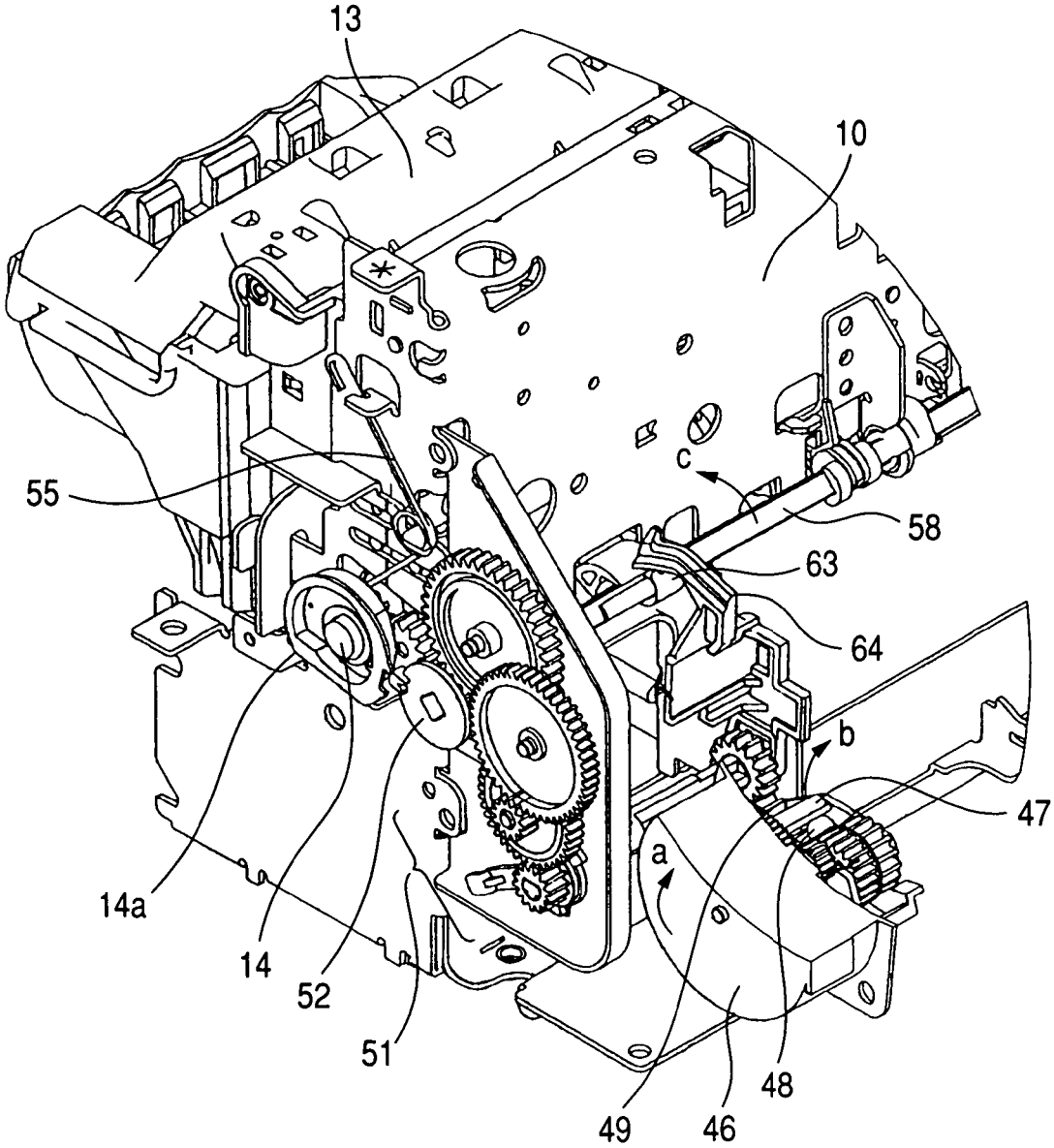
FIG. 9 is a schematic perspective view showing a life cam shaft drive mechanism in a recording apparatus in an embodiment of the present invention.

FIG. 9 is a schematic perspective view showing a lift cam shaft drive mechanism. In FIG. 9, there are shown an ASF motor 46 constituting a drive source (upper half being removed in illustration in order to show gears), an ASF pendulum arm 47 positioned next to a gear mounted on the ASF motor 46, an ASF solar gear mounted 48 at a center of the ASF pendulum arm 47, an ASF planet gear 49 mounted at an end of the ASF pendulum arm 47 and meshing with the ASF solar gear 48, a pendulum locking cam 63 fixed to the lift cam shaft 58, and a pendulum locking lever 64 capable of rocking to act on the pendulum locking cam 63.

As explained in the foregoing, the transmission of the driving force of the ASF motor 46 is switched, by the rotating direction thereof, to the lift cam shaft 58 and the main ASF 37, and the ASF motor 46 is rotated in a direction indicated by an arrow a in FIG. 9 for driving the lift cam shaft 58, whereby a gear mounted on the ASF motor 46 rotates the ASF solar gear 48. As the ASF solar gear 48 and the ASF pendulum arm 47 engage mutually rotatably with a predetermined frictional force, the ASF pendulum arm 47 rocks in the same direction as the rotating direction of the ASF solar gear 48, indicated by an arrow b in FIG. 9. Thus the ASF planet gear 49 meshes with a next lift input gear 50. In this manner the driving force of the ASF motor 46 is transmitted to the lift cam gear 52 through the lift reducing gear train 51. In this state, the ASF pendulum arm 47 rocks to the direction of the arrow b in FIG. 9, whereby the driving power to the gear train for driving the main ASF 37 is cut off.

On the other hand, in case of driving the main ASF 37, the ASF motor 46 is rotated opposite to the direction of the arrow a in FIG. 9, so that the ASF pendulum arm 47 rocks in a direction opposite to the arrow b in FIG. 9. Thus, the ASF planet gear 49 is released from the lift input gear 50, and another ASF planet gear 49 provided on the ASF pendulum arm 47 meshes with the gear train of the main ASF 37, thereby driving the main ASF 37.

In the present embodiment, the ASF motor 46 is constituted of so-called stepping motor with an open loop control, but it is naturally possible to employ a closed loop control utilizing an encoder on a DC motor or the like.

In case a planet gear mechanism is employed for the driving power transmission and a negative load is generated at the driven side, there may result so-called an overtaken state in which the gears are disengaged by a movement of the pendulum lock lever 64 and the driven side advances in phase relative to the driving side. In order to prevent such phenomenon, the present embodiment is provided with the pendulum locking cam 63 and the pendulum locking lever 64.

In case the lift cam shaft 58 is within a predetermined angular range, based on a cam face shape of the pendulum locking cam 63, the pendulum locking lever 64 rocks in a direction of an arrow c in FIG. 9 whereby the pendulum locking lever 64 engages with and fixes the ASF pendulum arm 47 so as not to return to the side for driving the main ASF 37. Therefore, the ASF planet gear 49 is constantly maintained in a meshing state with the lift input gear 50, and the ASF motor 46 and the lift cam shaft 58 rotate always in synchronization.

In case the pendulum locking cam 63 is brought to an angular range outside the aforementioned angular range, the pendulum locking lever 64 returns in a direction opposite to the arrow c in FIG. 9, whereby the ASF pendulum arm 47 is unlocked and the driving power transmission can be switched to the main ASF 37 by a reverse rotation of the ASF motor 46.

The aforementioned mechanisms enable a release of the pinch roller 22, a locking of the PE sensor lever 66, a pressure regulation of the pinch roller spring 24, a vertical movement of the sheet guide 70 and a vertical movement of the carriage 13. In the following, these five mechanisms will be collectively called lift mechanisms.

In the following, there will be explained how these mechanisms function in mutual correlation.

FIGS. 10A, 10B, 10C and 10D are schematic lateral views showing functions of the carriage 13, the pinch roller 22, the PE sensor lever 66 and the sheet guide 70.

Figure 10A:
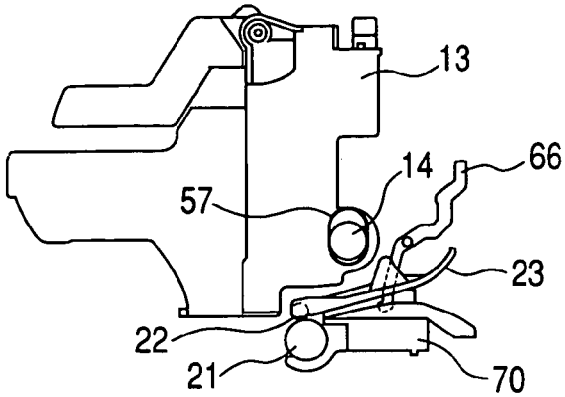
FIGS. 10A, 10B, 10C and 10D are schematic lateral cross-sectional views showing states in different positions of a lift mechanism in a recording apparatus of an embodiment of the present invention.

FIG. 10A shows a state where the lift mechanisms are in a first position. In this state, the pinch roller 22 is pressed (press-contacted) to the sheet conveying roller 21, the PE sensor lever 66 is in a free state, the pinch roller spring 24 generates an ordinary pressure, the sheet guide 70 is in an up-state, and the carriage 13 is in the first carriage position. This state is used for a recording operation utilizing an ordinary recording sheet, and for a registration after the inversion of the recording sheet in the auto both-side unit 2.

Figure 10B:
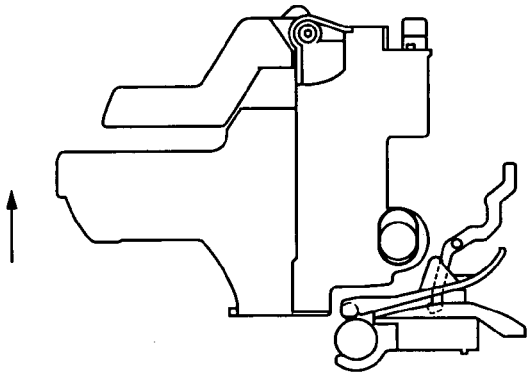

FIG. 10B shows a state where the lift mechanisms are in a second position. In this state, the pinch roller 22 is pressed to the sheet conveying roller 21, the PE sensor lever 66 is in a free state, the pinch roller spring 24 generates an ordinary pressure, the sheet guide 70 is in an up-state, and the carriage 13 is in the second carriage position. In comparison with the first position of the lift mechanisms, this state is different only in the position of the carriage 13. This state is used for preventing a contact of the recording sheet and the recording head 11 in case the recording sheet shows a large deformation, or for a recording sheet of a certain larger thickness.

Figure 10C:
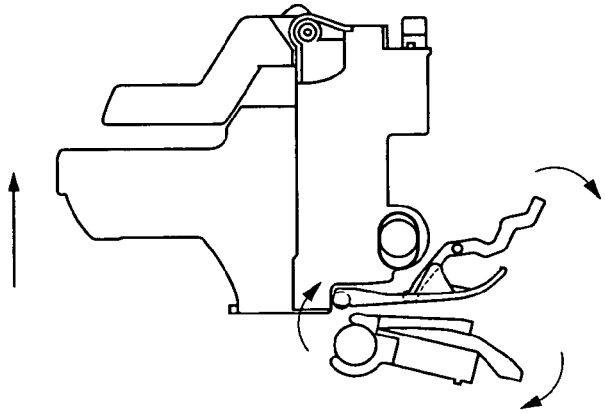

FIG. 10C shows a state where the lift mechanisms are in a third position. In this state, the pinch roller 22 is released with a predetermined gap from the sheet conveying roller 21, the PE sensor lever 66 is retracted upward and locked, the pinch roller spring 24 has a weaker pressure, the sheet guide 70 is in a down-state, and the carriage 13 is in the highest third carriage position. In comparison with the second position of the lift mechanisms, states are changed in all the mechanisms to open the sheet path in a straight state and to enable introduction of the recording sheet into the nip portion of the sheet conveying roller 21. This state is used for conveying the recording sheet in a direction of an arrow b in FIG. 2 after the recording on the front side of the recording sheet, or for inserting a recording sheet of a large thickness.

Figure 10D:
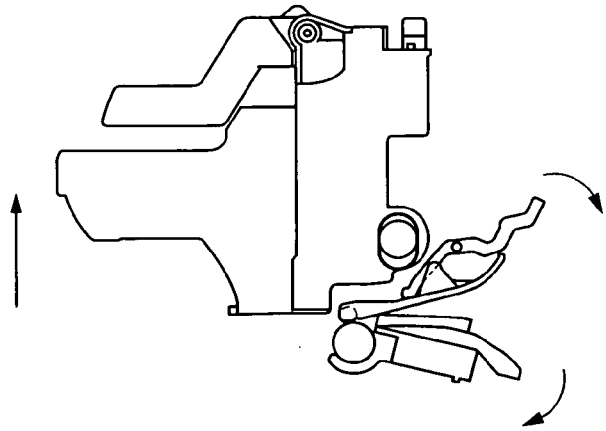

FIG. 10D shows a state where the lift mechanisms are in a fourth position. In this state, the pinch roller 22 is pressed to the sheet conveying roller 21, the PE sensor lever 66 is retracted upward and locked, the pinch roller spring 24 generates a somewhat weaker pressure, the sheet guide 70 is in a down-state, and the carriage 13 is in the highest third carriage position. In comparison with the third position of the lift mechanisms, the pinch roller 22 returns to the pressed state, and the pinch roller spring 24 is so changed as to generate a somewhat weaker pressure. This state is used in case of conveying, in an auto both-side recording, the recording sheet toward the auto both-side unit 2 after the re-introduction of the recording sheet, or for a recording with a recording sheet of a large thickness.

In the present embodiment, in consideration of the functions of the recording apparatus, the lift mechanisms are limited to the aforementioned four positions in order to simplify the configuration. More specifically, the positions change cyclically in the order of first position—second position—third position—fourth position during a turn of the lift cam shaft 58. However, the present invention is not limited to such embodiment, and there may be employed a configuration in which the components of the mechanisms are operated independently. Also the pressure regulating mechanism for the pinch roller spring 24 is not essential, but can be dispensed with in case the pinch roller holder 23 has a sufficiently high rigidity or the load fluctuation of the LF motor 26 is negligible. Also the vertical movement mechanism for the sheet guide 70 may be dispensed with, in case, for example by a positioning of the main ASF 37, the front edge of the recording sheet can be satisfactorily guided to the nip portion of the sheet conveying roller 21 even with a horizontal sheet guide 70.

Figure 11:
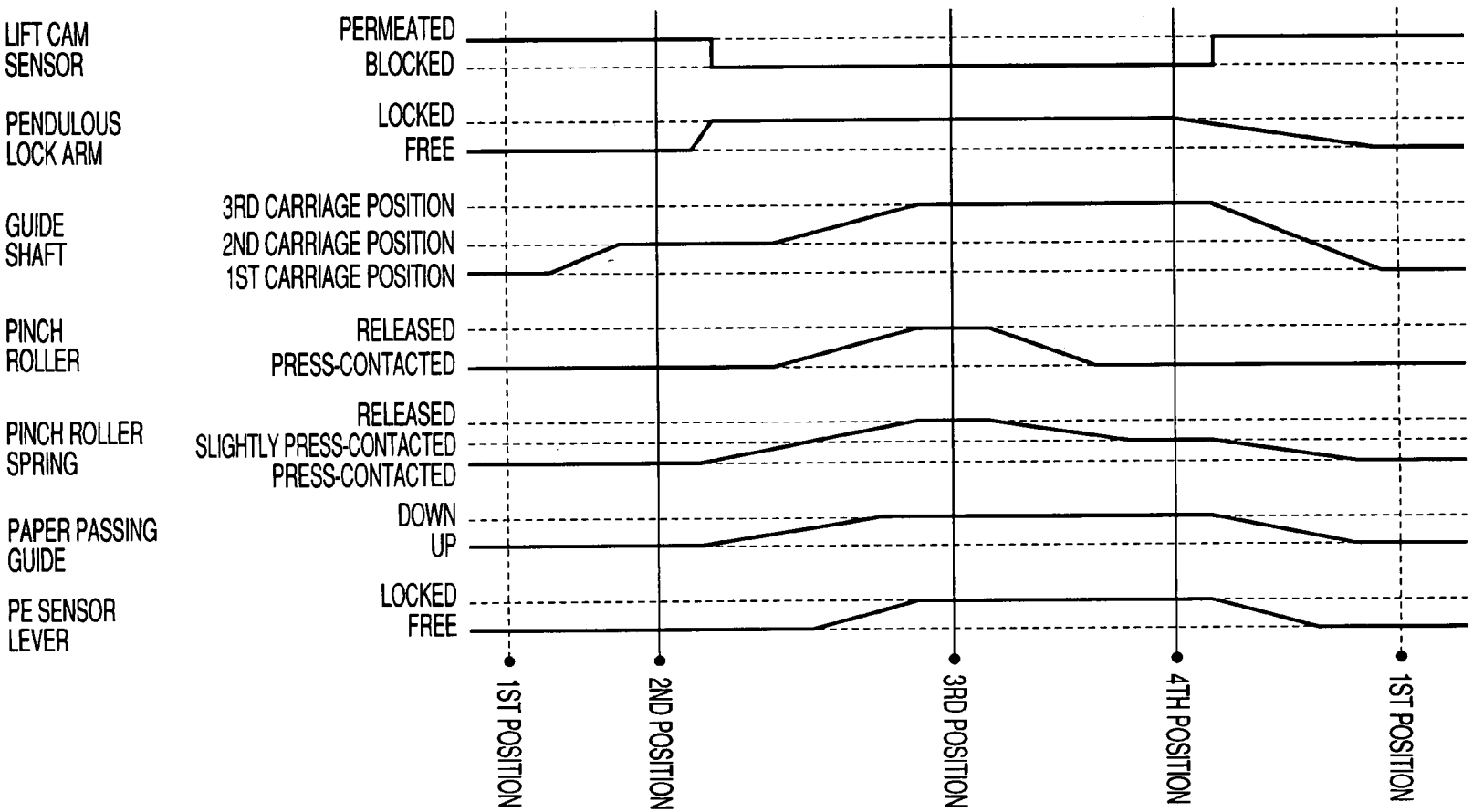
FIG. 11 is a timing chart showing operation states of the lift mechanism in the recording apparatus of an embodiment of the present invention.

In order to clarify further the contents explained in the foregoing schematic lateral views, an explanation will be given again with reference to a timing chart. FIG. 11 is a timing chart showing the function states of the lift mechanisms. The abscissa indicates an angle of the lift cam shaft 58, over a range of 360° from a first position shown at the left-hand side to a first position shown at the right-hand side. The ordinate schematically indicates a position of each mechanism. As shown in FIG. 11, an operation of the lift cam shaft 58 causes the plural mechanisms to be operated at mutually synchronized predetermined timings. The function states of the lift mechanisms can be identified by detecting the angle of the lift cam shaft 58 by the lift cam sensor 69, and can be simultaneously regulated by a control of the rotation angle of the ASF motor 46.

The functions of the lift mechanisms have been explained in the foregoing.

In the following, a specific explanation will be given on how an auto both-side recording is achieved on a recording sheet.

Figure 12A:
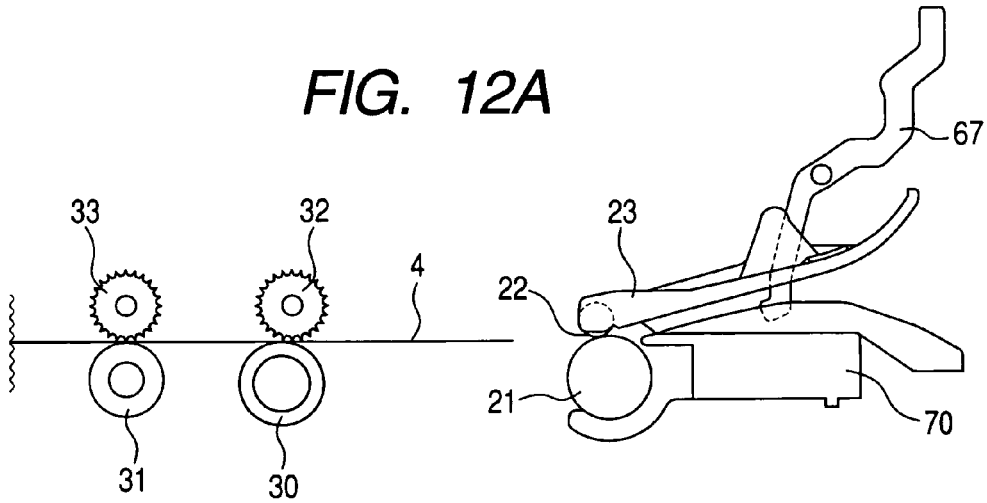
FIGS. 12A, 12B and 12C are schematic lateral cross-sectional views showing states of conveying a recording sheet to an auto inversion unit in a recording apparatus of an embodiment of the present invention.
Figure 12B:
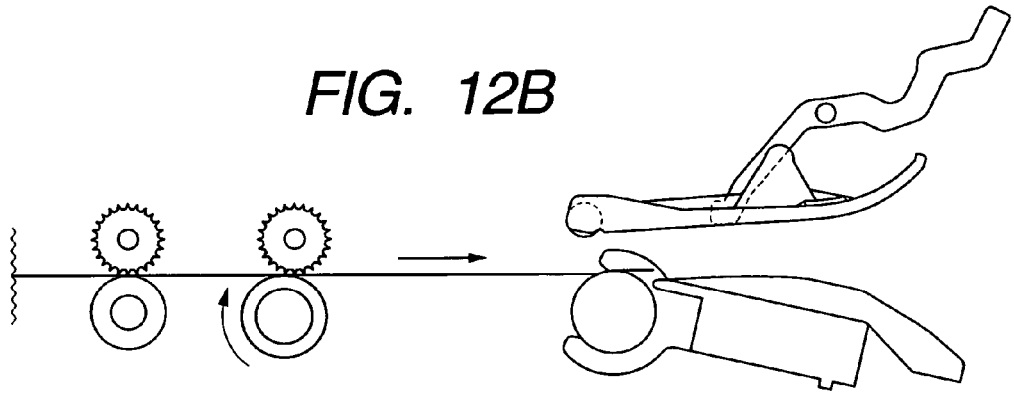
Figure 12C:
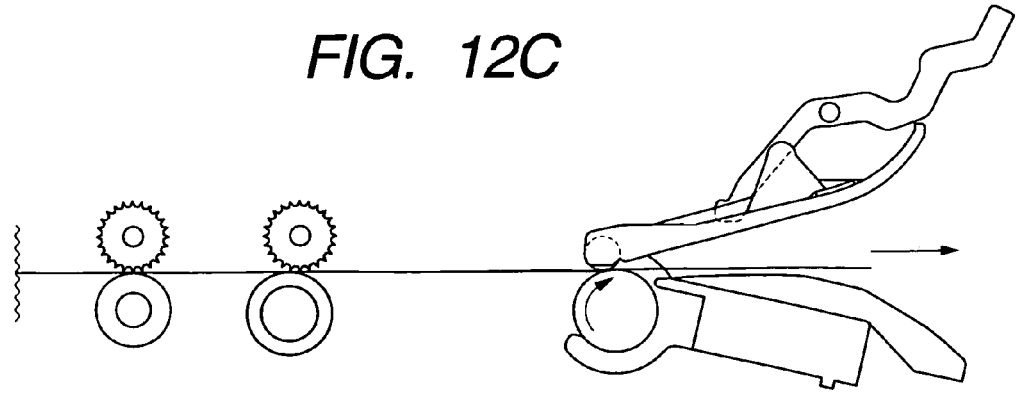

FIGS. 12A, 12B and 12C are schematic lateral views showing steps of re-entry of a recording sheet 4, after a recording on a front side thereof, into the nip portion of the sheet conveying roller 21.

FIG. 12A shows a state where the recording sheet 4 has completed the recording on the front side and is supported by the first sheet discharge roller 30 and the first spur train 32, and the second sheet discharge roller 31 and the second spur train 33. In this state, the lift mechanisms are in the first or second position. As explained in the foregoing, by executing the recording under advancement of the recording sheet 4 to such position, the rear end of the recording sheet 4 can be brought to a position opposed to the discharge nozzle array of the recording head 11, whereby it is rendered possible to execute the recording down to the rear end of the recording sheet 4 without forming a rear margin thereon.

Then the lift mechanisms are shifted to the third position, thereby forming a predetermined large gap between the pinch roller 22 and the sheet conveying roller 21. It is thus rendered possible to easily introduce the rear end of the recording sheet 4, even with a certain undulation or an upward curling, into the nip portion of the sheet conveying roller 21. In this state, the pinch roller holder 23 is lifted at a side where the pinch roller 22 is provided, but the carriage 13 is simultaneously lifted to a suitable position to avoid an interference of the pinch roller holder 23 and the carriage 13, so that the carriage 13 may be present in any position in the main scanning direction.

FIG. 12B shows a state where the recording sheet 4 is conveyed in a direction of the arrow b in FIG. 2 (hereinafter the conveying of the recording sheet 4 in such direction being called a back-feed) and is stopped under the pinch roller 22. A stopping in this state is adopted because the recording apparatus of the present embodiment employs an ink jet recording method of wet type. The recorded side of the recording sheet 4 (upper surface in FIGS. 12A, 12B and 12C) is in a wet state immediately after the recording operation and is stopped in an unpressed state, because an immediate pinching by the pinch roller 22 and the sheet conveying roller 21 may cause a situation where the ink is transferred onto the pinch roller 22 and is transferred again onto the recording sheet 4 in a subsequent conveying process thereby causing a smear thereon.

A time until the ink becoming no longer transferable onto the pinch roller 22, namely a time required for drying of the ink deposited on the recording sheet 4, is influenced by various factors. Such factors include a type of the recording sheet 4, a type of the used ink, a superposed deposition method of the used ink, a deposition amount of the used ink per unit area, an environmental temperature of the recording operation, an environmental humidity of the recording operation, an environmental gas flow rate of the recording operation etc.

In brief, the ink tends to dry faster on a recording sheet having an ink receiving layer at the surface and capable of introducing the ink promptly into the interior. Also a faster drying is possible with an ink employing smaller ink particles such as a dye and easily permeable into the interior of the recording sheet. Also a faster drying is possible with an ink system utilizing chemically reactive inks which are solidified by superposed deposition onto the surface of the recording sheet. Also a faster drying is possible by reducing the ink amount deposited per unit area. Also a faster drying is possible by elevating the environmental temperature of the recording operation. Also a faster drying is possible by lowering the environmental humidity of the recording operation. Also a faster drying is possible by elevating the environmental gas flow rate of the recording operation.

Since the necessary drying time varies by various conditions as explained above, the present embodiment adopts a configuration of employing, as a standard value, a drying time required in a recording operation with a predetermined ink system under ordinary conditions of use (ordinary recording sheet and ordinary recording environment), and regulating such standard value with a predictable condition to obtain a drying time.

The predictable condition is an ink amount deposited per unit area, but it is possible also to achieve a finer prediction of the waiting time for drying, by employing means for detecting the environmental temperature, means for detecting the environmental humidity, means for detecting the environmental air flow rate etc. in combination. Such regulation of the drying time can be achieved, for example, by storing the data received from the host apparatus 308 in the RAM 312, calculating the ink amount to be deposited per unit area and comparing a maximum value with a predetermined threshold value stored in the ROM 311, thereby determining the waiting time for drying. The waiting time for drying can be optimized according to the pattern to be recorded, by increasing the waiting time for a larger maximum value of the ink amount per unit area and decreasing the waiting time for a smaller maximum value.

The waiting time for drying is also variable depending on whether the ink used for recording is a dye-based ink or a pigment-based ink, and may be made shorter for a dye-based ink which dries faster and longer for a pigment-based ink which dries slower. Also the waiting time for drying may be made shorter at a higher ambient temperature causing a faster drying, or longer at a lower ambient temperature causing a slower drying. Also the waiting time for drying may be made longer at a higher ambient humidity causing a slower drying, or shorter at a lower ambient humidity causing a faster drying. Also the waiting time for drying may be made shorter in case of a recording sheet having an ink receiving layer on the surface and capable of immediately introducing the deposited ink into the interior because the surface of the recording sheet can be easily dried, and made longer for a strongly water-repellent recording sheet which is more difficult to dry.

Such waiting for drying may be made in the state shown in FIG. 12A, but is preferably executed after a back-feed of the recording sheet 4 to a position shown in FIG. 12B. This is because of a deformation in the recording sheet 4. In case of a recording on the recording sheet 4 with a wet ink jet process, a water absorption of the recording sheet 4 causes a dilatation of fibers constituting the recording sheet 4, thereby resulting in an elongation thereof. Depending on the recorded pattern, the recording sheet 4 may generate a relatively significantly elongated portion and a relatively insignificantly elongated portion, and, in such case, the surface of the recording sheet 4 shows a conspicuous undulation with a lapse of time after the recording. Magnitude of such undulation depends principally on the time after the start of water absorption by the recording sheet 4, and increases with the lapse of time, converging to a predetermined deformation amount. Therefore, in case the deformation at the end of the recording sheet 4 becomes large after a prolonged lapse of time, even if the pinch roller 22 is released from the sheet conveying roller 21, there is a possibility that the end portion of the recording sheet 4 interferes with the pinch roller 22 thereby causing a jam. In order to avoid such situation, the recording sheet 4 after the recording is subjected to the back-feeding and is moved to the position under the pinch roller 22 before the undulation by the deformation of the recording sheet 4 becomes large. Because of the aforementioned reason, the present embodiment adopts a configuration of awaiting the drying of the recorded portion of the recording sheet 4 after back-feeding of the rear end of the recording sheet 4 to the position shown in FIG. 12B.

FIG. 12C shows a state in which the recording sheet is conveyed to the auto both-side unit 2. When the recorded portion of the recording sheet 4 is dried and reaches a state where the ink is no longer transferred to the pinch roller 22 in a contact state, the lift mechanisms are shifted to the fourth position to pinch the recording sheet 4 by the pinch roller 22 and the sheet conveying roller 21. In this state the sheet conveying roller 21 is driven to back-feed the recording sheet 4.

In this state, since the PE sensor lever 66 is rotated upward and locked, there can be prevented a situation where the end portion thereof is trapped in the recording sheet 4 or rubs the recorded portion to cause a peeling. Also the sheet guide 70 is in the down-state and forms a substantially horizontal sheet path, so that the recording sheet 4 can be straightly conveyed toward the auto both-side unit 2.

In the present embodiment, the sheet guide 70 is basically maintained in the up-state, but the present invention is not restricted by such embodiment and the sheet guide 70 may be normally maintained in the down-state. More specifically, the lift mechanisms may normally wait in the third or fourth position and may be shifted to the first position at the sheet feeding operation from the main ASF 37. Such configuration enables a smooth insertion at the insertion of a recording sheet of a high rigidity from the side of the sheet discharge rollers.

The conveying of the recording sheet 4 after the end of the recording on the front side to the auto both-side unit 2 is conducted as explained above.

In the following a conveying of the recording sheet 4 in the auto both-side unit 2 will be explained.

Figure 13:
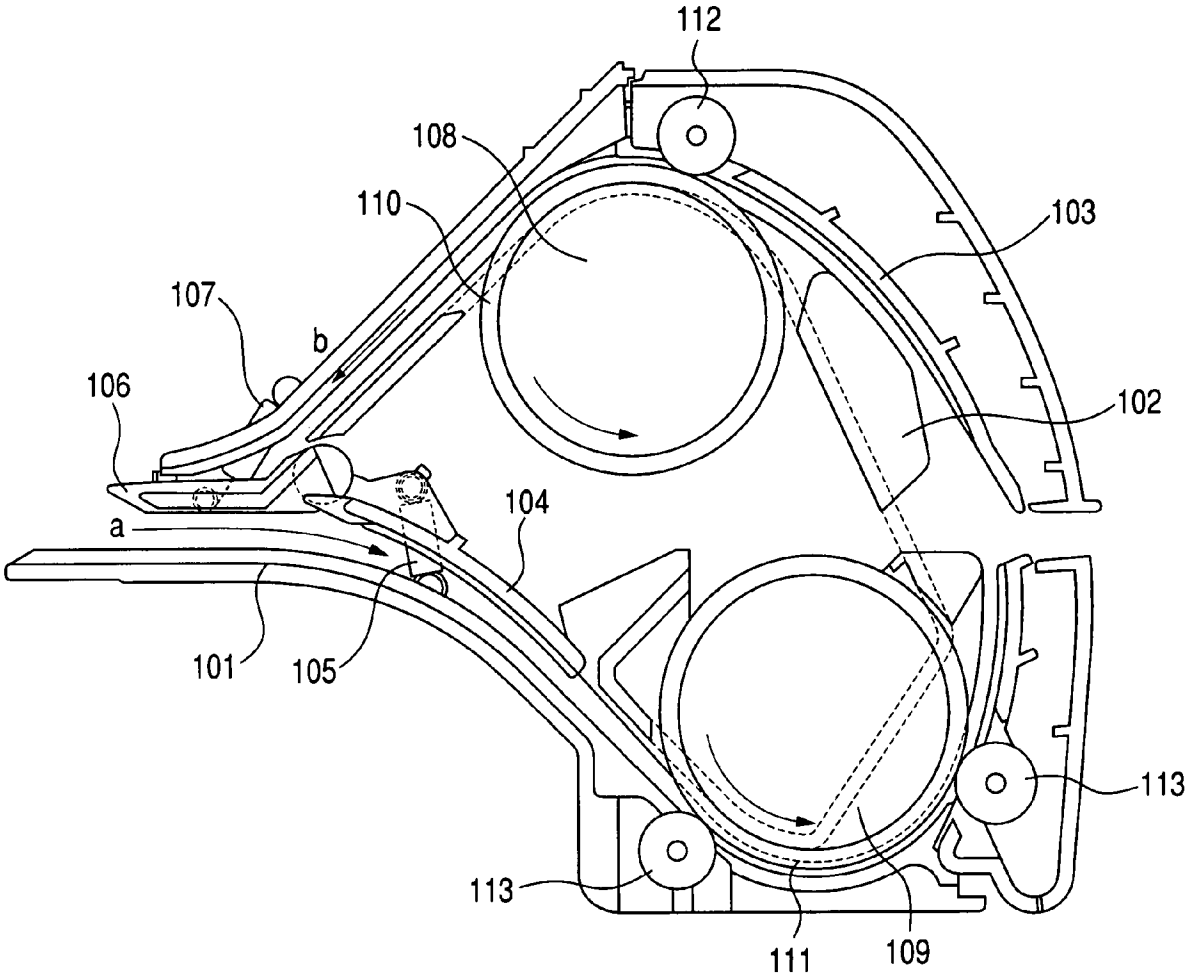
FIG. 13 is a schematic lateral cross-sectional view showing a configuration of an auto both-side unit in a recording apparatus in an embodiment of the present invention.

FIG. 13 is a schematic lateral cross-sectional view showing arrangement of a sheet path and conveying rollers in the auto both-side unit 2.

Referring to FIG. 13, there are shown a both-side unit frame 101 constituting a structural member of the auto both-side unit 2 and constituting a part of a sheet conveying path, an inner guide 102 fixed in the interior of the both-side unit frame 101 and constituting a part of the sheet conveying path, a rear cover 103 provided open-closably in a rear part of the both-side unit frame 101 and constituting a part of the sheet conveying path, a switching flap spring 105 for biasing a switching flap 104 in a predetermined direction, an exit flap spring 107 for biasing an exit flap 106 in a predetermined direction, a both-side roller rubber A 110 constituting a rubber portion of a both-side roller A 108, and a both-side roller rubber B 111 constituting a rubber portion of a both-side roller B 109.

When the recording sheet 4 is conveyed in a state shown in FIG. 12C to the auto both-side unit 2, the exit flap 106 is biased, by the function of the exit flap spring 107, in a position closing an upper conveying path and opening a lower conveying path as shown in FIG. 13, so that an entrance path is determined uniquely. Therefore the recording sheet 4 proceeds to the lower conveying path as indicated by an arrow a in FIG. 13. Then the recording sheet 4 impinges on the switching flap 104, and, since the switching flap spring 105 is so selected that the switching flap 104 does not rotate for an ordinary recording sheet 4 which does not have an excessively high rigidity and is suitable for both-side recording, the recording sheet 4 proceeds inclinedly downward along a sheet path between the switching flap 104 and the both-side unit frame 101.

The recording sheet 4, proceeding in this state, is contacted at the recorded (front) side thereof with the both-side roller rubber B 111 of the both-side roller B 109 and at the unrecorded (back) side thereof with the both-side pinch roller B 113 formed by a polymer material of a high lubricating property, and is supported therebetween. Since the both-side roller A 108, the both-side roller B 109 and the sheet conveying roller 21 are rotated at substantially same peripheral speeds by a drive mechanism to be explained later, the recording sheet 4 is conveyed without a slippage to the both-side roller B 109. Also such substantially same peripheral speeds prevent the recording sheet 4 from becoming slack or subjected to a tension.

After a change in the advancing direction along the both-side roller B 109, the recording sheet 4 proceeds along the rear cover 103 and is similarly supported between the both-side roller rubber A 110 of the both-side roller A 108 and the both-side pinch roller A 112. After a change in the advancing direction again along the both-side roller A 108, the recording sheet 4 is conveyed in a direction of an arrow b in FIG. 13.

In the course of advancement of the recording sheet 4 in this state, the front edge thereof impinges on the exit flap 106. The exit flap 106 is biased by the exit flap spring 107 of a very low power in such a manner that the recording sheet 4 itself can push away the exit flap 106 and can exit from the auto both-side unit 2. Also the sheet path length in the auto both-side unit 2 is selected such that the rear end of the recording sheet 4 in the advancing direction thereof has already passed under the exit flap 106 when the front edge of the recording sheet 4 in the advancing direction thereof exits from the exit flap 106, so that there is no mutual friction between the front edge portion and the rear edge portion of the recording sheet 4.

Detailed operations will be explained later with reference to a flow chart. However, at the recording on the front side of the recording sheet 4, in case a recording sheet shorter than the distance from the sheet conveying roller 21 to the both-side roller B 109 or shorter than the distance from the both-side roller A 108 to the sheet conveying roller 21, or a recording sheet longer than a turn-around distance of the auto both-side unit 2 from the exit flap 106 to the exit flap 106 is inserted, an alarm is given at the completion of the recording on the front side and the recording sheet 4 is discharged without conveying to the auto both-side unit 2. Such process can be executed automatically by measuring the length of the recording sheet by the PE sensor lever 66.

Now there will be explained reason why the recorded surface of the recording sheet 4 is conveyed at the side of the both-side roller rubber A 110 and the both-side roller rubber B 111. The both-side roller rubber A 110 and the both-side roller rubber B 111 are in the driving side, while the both-side pinch roller A 112 and the both-side pinch roller B 113 are in the driven side. Therefore, the recording sheet 4 is conveyed by the rollers of the driving side, and the rollers of the driven side are rotated by the friction with the recording sheet 4. Such driving method is acceptable when the rotary axes supporting the both-side pinch roller A 112 and the both-side pinch roller B 113 have a sufficiently small axial loss, but in case the axial loss increases for some reason, there may result a slippage between the recording sheet 4 and the both-side pinch roller A 112 or the both-side pinch roller B 113. The recorded portion of the recording sheet 4 has been dried to such an extent that the ink is not transferred by a contact with the roller, but there may result an ink peeling from the surface of the recording sheet 4 in case it is rubbed. Stated differently, in case the recorded surface of the recording sheet 4 is maintained in contact with the both-side pinch roller A 112 and the both-side pinch roller B 113 and causes a slippage to such rollers, the ink on the recorded surface may be peeled off. In order to avoid such situation, the present embodiment employs such an arrangement that the rollers of the driving side are contacted with the recorded (front) side and the rollers of the driven side are contacted with the unrecorded (back) side.

Another reason, to be explained in the following, can also be mentioned for adopting such arrangement. The both-side roller A 108 or the both-side roller B 109 of the driving side is preferably given a certain large diameter because of a restriction that a radius of curvature of the recording sheet 4 should not preferably be made excessively small, while the both-side pinch roller A 112 or the both-side pinch roller B 113 can be realized with a small diameter. Therefore, for designing a compact auto both-side unit 2, the both-side pinch roller A 112 and the both-side pinch roller B 113 are often designed with a small diameter. Also the recorded surface of the recording sheet 4 does not basically cause a transfer of the ink to the contacting roller, but may still cause a transfer in a very small amount, thereby gradually smearing the roller which is in contact with the recorded surface. A roller of a smaller diameter, having a higher frequency of contact of a unit peripheral area of the roller with the recording sheet 4, is smeared faster than a roller of a larger diameter and can therefore be considered disadvantageous with respect to such smearing. In consideration of such compactization of the apparatus and such roller smearing, the present embodiment adopts an arrangement in which the recorded (front) side of the recording sheet is contacted by the both-side roller A 108 and the both-side roller B 109 of larger diameters.

Another reason, to be explained in the following, can also be mentioned for adopting such arrangement. In case of pinching and conveying a recording sheet by a pair of rollers one of which is driven, it is customary to employ an elastic material in either of the rollers in order to secure a certain nip area, and, in order to obtain an accurate conveying amount, to employ a material of a high friction coefficient at the driving side and a material of a low friction coefficient at the driven side. A rubber material providing a high friction coefficient and a high elasticity with a low cost is usually employed for the material constituting the roller of the driving side. Also for increasing the conveying power, there is often employed a structure of applying a surface polishing on the rubber, including an elastomer or the like, and intentionally leaving polishing grains constituting minute irregularities. In such case, the driven side is usually formed with a polymer resin with a relatively low friction coefficient. In a comparison of a roller of which surface is formed by an elastic member, particularly a rubber with small surface irregularities, and a roller of which surface is formed by an non-elastic member, particularly a smooth polymer resin, the ink stain sticks to either roller when it is contacted with the recorded surface of the recording sheet, but the elastic member, particularly the rubber with minute surface irregularities, can retain the stain on the surface particularly because of such irregularities and transfers little the stain again onto the recording sheet, while the non-elastic member, particularly the smooth polymer resin tends to show peeling of the stain and cause a re-transfer onto the recording sheet. It is therefore considered advantageous to contact the roller of the elastic member with the recorded surface of the recording sheet. Also because of this reason, the present embodiment adopts an arrangement in which the elastic members, particularly rollers of a rubber material, are provided at a side contacting the recorded (front) side of the recording sheet and the non-elastic members, particularly rollers of a polymer resin material, are provided at a side contacting the non-recorded (back) side of the recording sheet.

The reversing operation for executing a both-side recording on an ordinary recording sheet has been explained in the foregoing.

In the following there will be explained functions of the auto both-side unit 2 in case of a recording on a highly rigid recording medium, without both-side recording.

A recording medium of a high rigidity can be, for example, a cardboard of a thickness of 2 to 3 mm, or a disk-shaped or irregular-shaped recording medium placed on a predetermined tray. Such recording medium, because of its high rigidity, cannot be so bent as to match the diameter of the both-side rollers in the auto both-side unit 2 and cannot, therefore, be subjected to an auto both-side recording. However, there can be conceived a situation where a recording on such recording medium is desired while the auto both-side unit 2 is attached to the recording apparatus. In case the recording medium has a high rigidity, a feeding by the main ASF 37 is also not possible, and the recording medium is fed from the side of the sheet discharge rollers 31, 32 toward the sheet conveying roller 21, utilizing the straight sheet path. The functions of the auto both-side unit 2 in such case will be explained in the following.

Figure 14A:
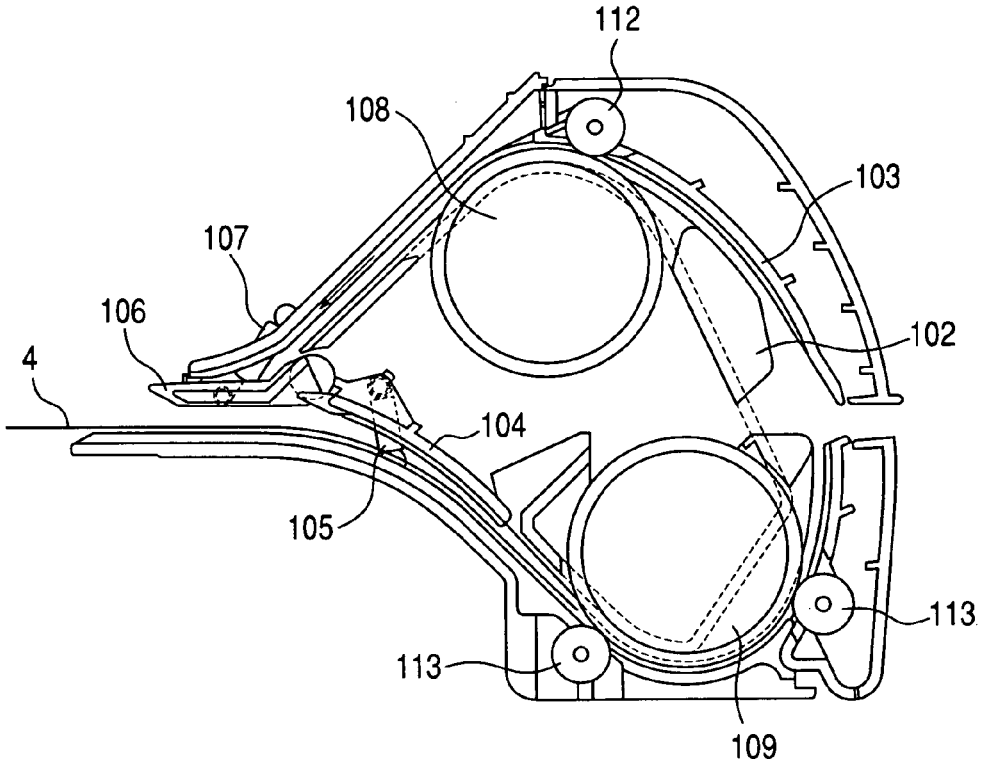
FIGS. 14A and 14B are schematic lateral cross-sectional views showing function of a flap in the auto both-side unit of a recording apparatus in an embodiment of the present invention.
Figure 14B:
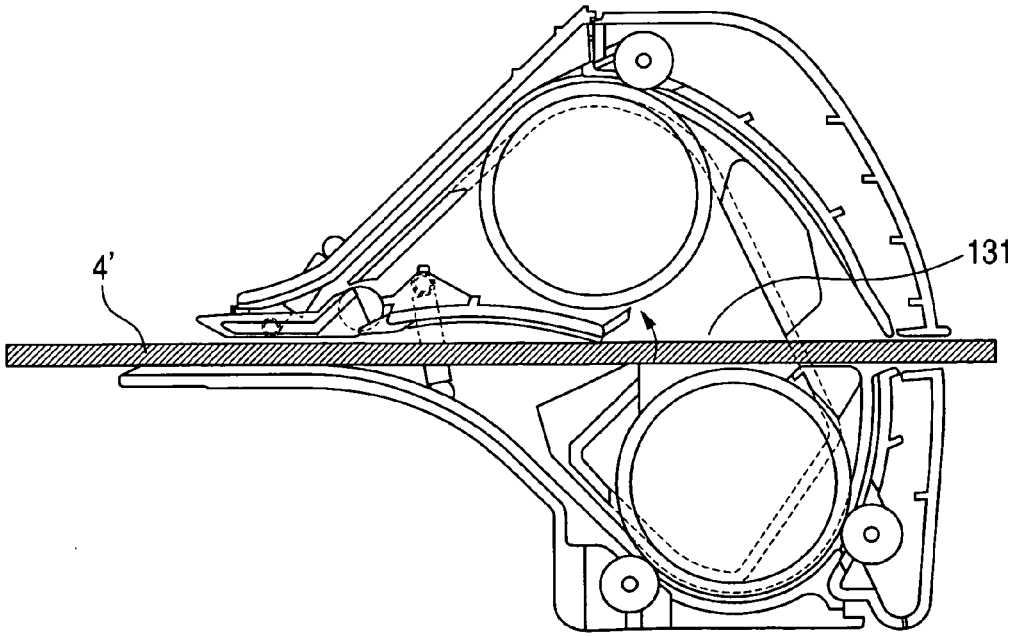

FIGS. 14A and 14B are schematic lateral cross-sectional views showing functions of the switching flap 104.

FIG. 14A shows a state in an auto both-side recording with an ordinary recording sheet 4 as explained in the foregoing. In this state, the switching flap spring 105 biases and maintains the switching flap 104 in contact with a stopper against the pressure of the recording sheet 4, so that the recording sheet 4 is guided to the aforementioned sheet path for inversion.

On the other hand, FIG. 14B shows a state of using a recording medium 4' of a high rigidity. The highly rigid recording medium 4', upon entering the auto both-side unit 2, passes under the exit flap 106 and impinges on the switching flap 104. Since the switching flap spring 105 is adjusted at such a load that the switching flap 104 can rock in a retracting direction upon being pressed by the inserted highly rigid recording medium 4', the switching flap 104 rocks counterclockwise and is moved to a retracted position with the advancement of the highly rigid recording medium 4'. Therefore, the highly rigid recording medium 4' is guided to a shunt path 131 constituting a second sheet path and provided between the both-side roller A 108 and the both-side roller B 109. The rear cover 103 has an aperture in a position corresponding to the shunt path 131, so that the highly rigid recording medium 4' even of a large length is not hindered in conveying by an interference with the auto both-side unit 2.

The present invention is not limited to such embodiment. It is not essential to form a shunt path 131 between the two both-side rollers at above and below, but there can also be adopted a following configuration.

Figure 22:
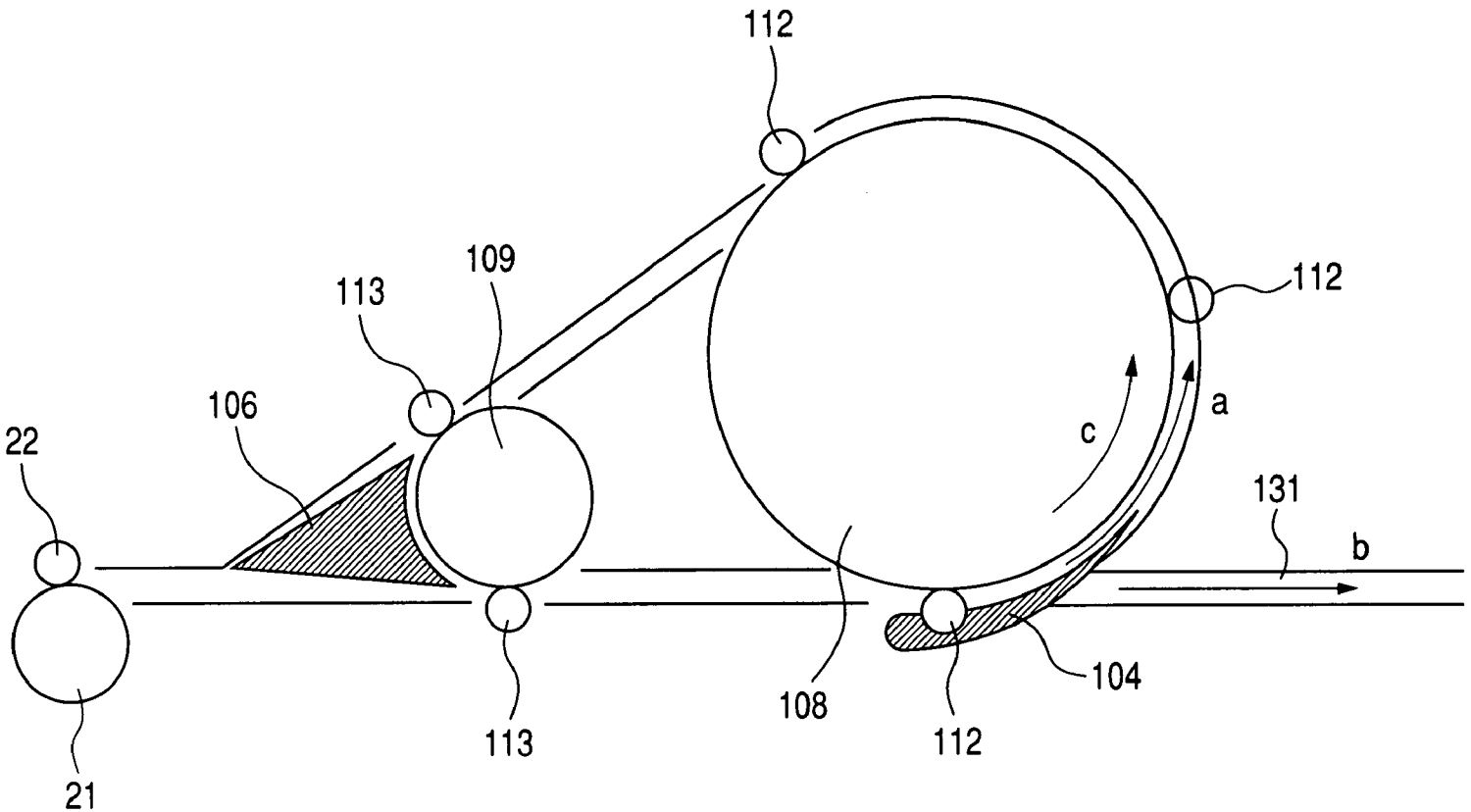
FIG. 22 is a schematic cross-sectional view showing a variation of an auto both-side unit in a recording apparatus of an embodiment of the present invention.

FIG. 22 is a schematic cross-sectional view showing an auto both-side unit 2 of a variation in which a both-side roller of a large diameter is positioned above a substantially horizontal path. Referring to FIG. 22, a switching flap 104 is biased, by an unillustrated switching flap spring, in a position forming a conveying path along a both-side roller A 108. Such switching flap spring is adjusted at such a spring pressure that the switching flap 104 is not rotated when contacted by an ordinary recording sheet of a low rigidity but is rotated when contacted by a highly rigid recording medium. Therefore, the recording sheet of low rigidity proceeds upward along the both-side roller A as indicated by an arrow a in FIG. 22 by the rotation of the both-side roller A 108 in a direction indicated by an arrow c in FIG. 22, but the recording medium of a high rigidity pushes away the switching flap 104 and proceeds straightly into a shunt path 131 as indicated by an arrow b in FIG. 22. Therefore, a highly rigid recording medium even of a large length is not hindered in conveying by an interference with the auto both-side unit 2.

As explained in the foregoing, in the auto both-side unit 2 of the present embodiment, it is possible to execute a one-side recording on a recording medium which has a high rigidity and cannot be bent much, without detaching the auto both-side unit 2.

The auto both-side unit 2 having two sheet paths has been explained in the foregoing.

In the following, there will be explained a drive mechanism for the rollers of the auto both-side unit 2.

Figure 15:
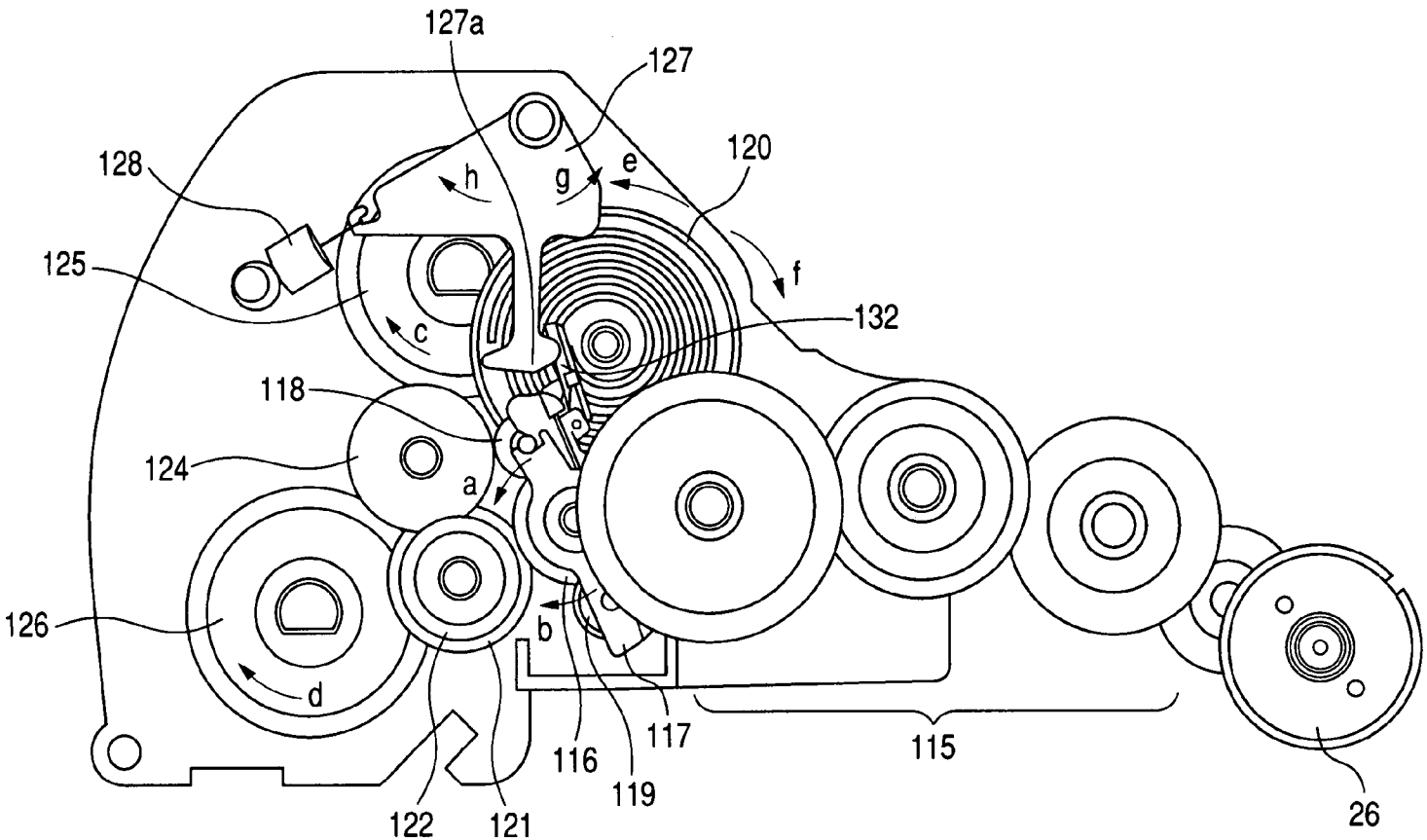
FIG. 15 is a schematic lateral cross-sectional view showing an auto both-side unit driving mechanism of a recording apparatus in an embodiment of the present invention.

FIG. 15 is a schematic lateral cross-sectional view showing a roller driving mechanism of the auto both-side unit 2, seen from a side opposite to that of FIG. 2.

Referring to FIG. 15, there are shown a both-side transmission gear train 115 for transmitting power from the LF motor 26 to a both-side solar gear 116, a both-side solar gear 116 positioned at a center of a both-side pendulum arm 117, a both-side pendulum arm 117 capable of rocking about the both-side solar gear 116, a both-side pendulum arm spring 132 mounted on the both-side pendulum arm 117, a both-side planet gear A 118 mounted rotatably on the both-side pendulum arm 117 and meshing with the both-side solar gear 116, and a similar both-side planet gear B 119. There are also shown an inversion delay gear A 121 meshing with the both-side planet gear B 119, an inversion delay gear B 122 concentric with the inversion delay gear A, a both-side roller gear A 125 fixed to the both-side roller A 108, a both-side roller gear B 126 fixed to the both-side roller B 109, and a both-side idler gear 124 connecting the two both-side roller gears. There are further provided a spiral groove gear 120 engaging with the both-side solar gear 116 through an idler, a stop arm 127 rocking by engaging with the groove of the spiral groove gear 120, and a stop arm spring 128 for centering the stop arm. Between the inversion delay gear A 121 and the inversion delay gear B 122, there is provided an unillustrated inversion delay gear spring for providing a biasing force in such a direction as to bring the relative rotational positions of the two to predetermined positions, as will be explained later.

In the present embodiment, as explained in the foregoing, the driving power for the auto both-side unit 2 is obtained from the LF motor 26 which drives the sheet conveying roller 21. Such configuration is preferred since, in conveying the recording sheet by the cooperation of the sheet conveying roller 21 and the both-side roller A 108 or B 109, an almost complete synchronization can be achieved in start/stop timing or in the conveying speed of the recording sheet.

A driving force from the LF motor 26 is transmitted to the both-side solar gear 116 through the both-side transmission gear train 115. On the both-side solar gear 116, there is mounted the both-side pendulum arm 117, on which the both-side planet gear A 118 and the both-side planet gear B 119 are mounted. As a suitable frictional force is provided between the both-side solar gear 116 and the both-side pendulum arm 117, the both-side pendulum arm 117 causes a rocking motion along the rotation of the both-side solar gear 116.

Now let it be assumed that a normal direction means a rotating direction of the LF motor 26 for causing the sheet conveying roller 21 to rotate in a direction to convey the recording sheet in the discharging direction, and that a reverse direction means a rotating direction of the LF motor 26 for conveying the recording sheet toward the auto both-side unit 2. When the LF motor 26 is rotated in the normal direction, the both-side solar gear 116 rotates in a direction indicated by an arrow a in FIG. 15. Along with the rotation of the both-side solar gear 116, the both-side pendulum arm 117 basically rocks in a direction of the arrow a in FIG. 15. As a result, the both-side planet gear A 118 meshes with the both-side roller idler gear 124, thereby rotating the both-side roller idler gear 124. By the rotation of the both-side roller idler gear 124, the both-side roller gear A 125 rotates in a direction of an arrow c in FIG. 15, while the both-side roller gear B 126 rotates in a direction of an arrow d in FIG. 15. The arrows c and d in FIG. 15 correspond to directions in which the both-side roller A 108 and the both-side roller B 109 respectively convey the recording sheet in the auto both-side unit 2.

When the LF motor 26 is rotated in the reverse direction, the both-side solar gear rotates in a direction of an arrow b in FIG. 15. With the rotation of the both-side solar gear 116, the both-side pendulum arm rocks in a direction of an arrow b in FIG. 15, whereupon the both-side planet gear B 119 meshes with the inversion delay gear A 121.

The inversion delay gear A 121 and the inversion delay gear B 122 respectively have projections, which protrude from mutually opposed thrust faces and which mutually engage when the inversion delay gear A 121 is rotated by one turn while the inversion delay gear B 122 is stopped, thereby achieving a clutch function. Prior to the engagement of the both-side planet gear B 119 with the inversion delay gear A 121, the inversion delay gear A 121 and the inversion delay gear B 122 are biased by the inversion delay gear spring 123 in such a direction that the projections are mutually separated, so that the inversion delay gear B 122 starts to rotate after about a turn of the inversion delay gear A 121 from the start of rotation thereof. Consequently, after the start of rotation of the LF motor 26 in the reverse direction, there is required a certain period until the inversion delay gear B 122 starts to rotate, and during the such period, the both-side roller A 108 and the both-side roller B 109 remain in a stopped state, thus generating a delay period.

A rotation of the inversion delay gear B 122 causes, through the both-side roller idler gear 124, the both-side roller gear A to rotate in a direction of the arrow c in FIG. 15 and the both-side roller gear B to rotate in a direction of the arrow d in FIG. 15. These rotating directions are same as those when the LF motor 26 is rotated in the normal direction. Therefore, this mechanism allows to rotate the both-side roller A 108 and the both-side roller B 109 constantly in a direction for conveying the recording sheet in a predetermined direction, regardless of the rotating direction of the LF motor 26.

In the following, there will be explained the function of the spiral groove gear 120. The spiral groove gear 120 is provided with gear teeth on the external periphery and, and, on an end face, with a cam formed by a spiral groove having an endless track at the innermost circumference and at the outermost circumference. In the present embodiment, the spiral groove gear 120 is connected with the both-side solar gear 116 across the idler gear, and therefore rotates in the same direction as and in synchronization with the both-side solar gear 116.

In the groove of the spiral groove gear 120, there engages a follower pin 127*a* constituting a part of the stop arm 127, which therefore rocks according to the rotation of the spiral groove gear 120. For example, when the spiral groove gear 120 rotates in a direction of an arrow e in FIG. 15, the follower pin 127*a* is guided in the spiral groove and is attracted to the internal part, whereby the stop arm 127 rocks in a direction of an arrow g in FIG. 15. In case the spiral groove gear 120 continues to rotate in the direction of the arrow e in FIG. 15, the follower pin 127*a* soon enters the endless track at the innermost circumference, whereby the rocking motion of the stop arm 127 stops at a predetermined position. On the other hand, in case the spiral groove gear 120 rotates in a direction of an arrow f in FIG. 15, the follower pin 127*a* is moved to the outer circumference whereby the stop arm 127 rocks in a direction indicated by an arrow h in FIG. 15. Similarly also in this case, when the spiral groove gear 120 continues to rotate in the direction of the arrow f in FIG. 15, the follower pin 127*a* soon enters the endless track at the outermost circumference, whereby the rocking motion of the stop arm 127 stops at a predetermined position. In order that the follower pin 127*a* can smoothly move from the outermost or innermost endless track to the spiral groove when the rotating direction of the spiral groove gear 120 is changed, a stop arm spring 128 is mounted on the stop arm 127 for causing a centering force to a center position at about the middle of the moving range of the stop arm 127.

The stop arm 127 functioning as explained above acts on the both-side pendulum arm spring 132 mounted on the both-side pendulum arm 117. The both-side pendulum arm spring 132 is an elastic member mounted on the both-side pendulum arm 117 and extending toward the stop arm 127. The front end of the both-side pendulum arm spring 132 is always positioned closer than the stop arm 127 to the center of the spiral groove gear 120.

Such configuration provides following functions when the LF motor 26 rotates in the normal direction.

When the recording sheet is conveyed to the auto both-side unit 2 by rotating the LF motor 26 in the reverse direction and is returned to the sheet conveying roller 21 after the front-back side inversion, the stop arm 127 is in such a state where the follower pin 127*a* thereof rotates on the outermost endless track of the spiral groove gear 120. Therefore, during the recording on the back side by rotating the LF motor 26 in the normal direction, the follower pin 127*a* of the stop arm 127 moves toward the internal circumference of the spiral groove gear 120. When the LF motor 26 rotates in the normal direction, since the both-side pendulum arm 117 executes power transmission by a rocking in the direction of the arrow a in FIG. 15, the stop arm 127 comes into contact with the both-side pendulum arm spring 132 in the course of rocking of the follower pin 127*a* thereof toward the internal circumference. When the LF motor 26 is further rotated in the normal direction, the stop arm 127 moves further to the internal circumference thereby causing an elastic deformation of the both-side pendulum arm spring 132.

In this state, the position of the both-side pendulum arm 117 is determined by a balance of a force, acting in an angular direction of pressure, of the meshing tooth faces of the both-side planet gear A 118 and the both-side roller idler gear 124 in mutually meshing state, a force for rocking the both-side pendulum arm 117 in the direction of the arrow a in FIG. 15 by a frictional force with the both-side solar gear 116, and a repulsive force of the both-side pendulum arm spring 132. In the present embodiment, the repulsive force of the both-side pendulum arm spring 132 is selected relatively so small that, even when the stop arm 127 rocks to a state where the follower pin 127*a* thereof enters the innermost endless track of the spiral groove gear 120, the power transmission between the both-side planet gear A 118 and the both-side roller idler gear 124 is continued with a mere elastic compression of the both-side pendulum arm spring 132. Also, even in case the operation of the LF motor 26 is intermittent and repeats rotation and stopping, teeth of the both-side plant gear A 118 and the both-side roller idler gear 124 continue to mesh and are not disengaged even during a stopped state.

However, when the recording on the back side of the recording sheet 4 is completed and the power transmission to the auto both-side unit 2 becomes unnecessary, it is preferable to disconnect the drive in order to reduce the load on the LF motor 26. Therefore, following operations are executed in case of disconnecting the power transmission. More specifically, the LF motor 26 is slightly rotated in the reverse direction, in a state where the stop arm 127 is in the innermost endless track and the both-side pendulum arm spring 132 is elastically deformed. In this operation, while the both-side pendulum arm 117 is in a state of receiving a rotating force in a direction of an arrow b in FIG. 15 by the repulsive force of the both-side pendulum arm spring 132 but being stopped by the mutual meshing of the teeth of the both-side planet gear A 118 and the both-side roller idler gear 124, a rotation in a direction of disengaging the mutual meshing of the teeth is given in such state, whereby the both-side pendulum arm 117 rotates at once in a direction of an arrow b in FIG. 15. Thus the LF motor 26 is detached from the both-side roller gear A 125 and the both-side roller gear B 126, so that the load on the LF motor 26 can be reduced.

Once the both-side pendulum arm 117 is rotated in the direction of the arrow b in FIG. 15 as explained above, the elastically deformed both-side pendulum arm spring 132 returns to the original state. Therefore, even in case the LF motor 26 is rotated in the normal-direction in this state, because of the interference of the both-side pendulum arm spring 132 and the stop arm 127, the both-side pendulum arm 117 cannot cause a rocking motion and the both-side planet gear A 118 and the both-side roller idler gear 124 cannot mutually mesh. Therefore, from this state, the driving power cannot be transmitted to the both-side pendulum arm 117 and the subsequent components in the auto both-side unit 2 unless the LF motor 26 is rotated in the reverse direction by a predetermined amount.

The drive up to the both-side pendulum arm 117 merely involves rotation of a gear train and only requires a little load on the LF motor 26, almost comparable to that when the auto both-side unit 2 is not attached. In case the LF motor 26 is rotated in the reverse direction from a state where the stop arm 127 is in the innermost endless track, the power transmission to the inversion delay gear A 121 can be executed as explained before, since there is no effect between the both-side pendulum arm spring 132 and the stop arm 127.

The drive mechanism for the rollers of the auto both-side unit 2 has been explained in the foregoing.

In the following, details of the function of the roller driving mechanism of the auto both-side unit 2 will be explained with reference to a flow chart.

Figures 20, 20A:
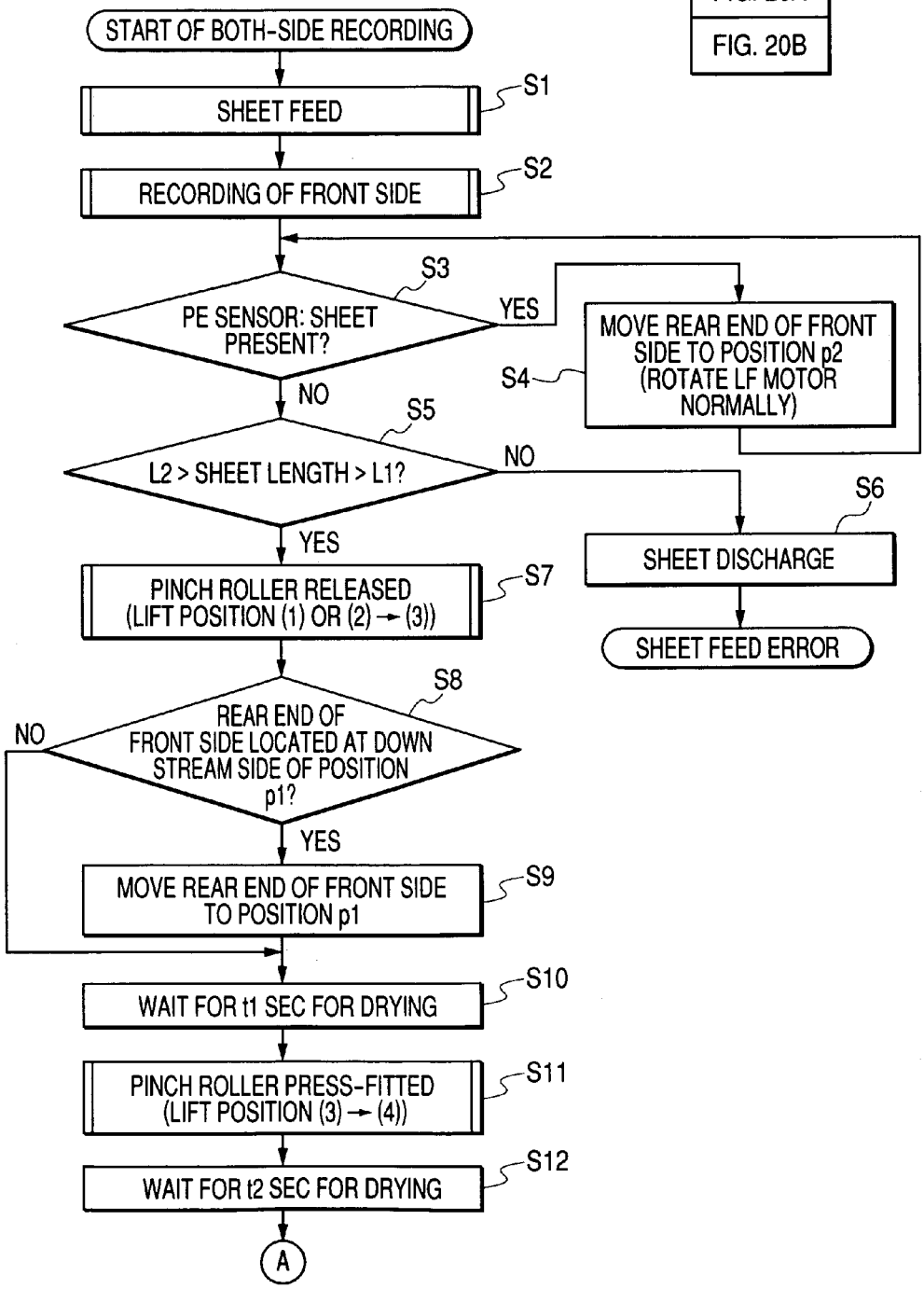
FIGS. 20A and 20B are combined as shown in FIG. 20, and they are flow charts showing a sequence of an auto both-side recording operation in a recording apparatus of an embodiment of the present invention.
Figure 20B:
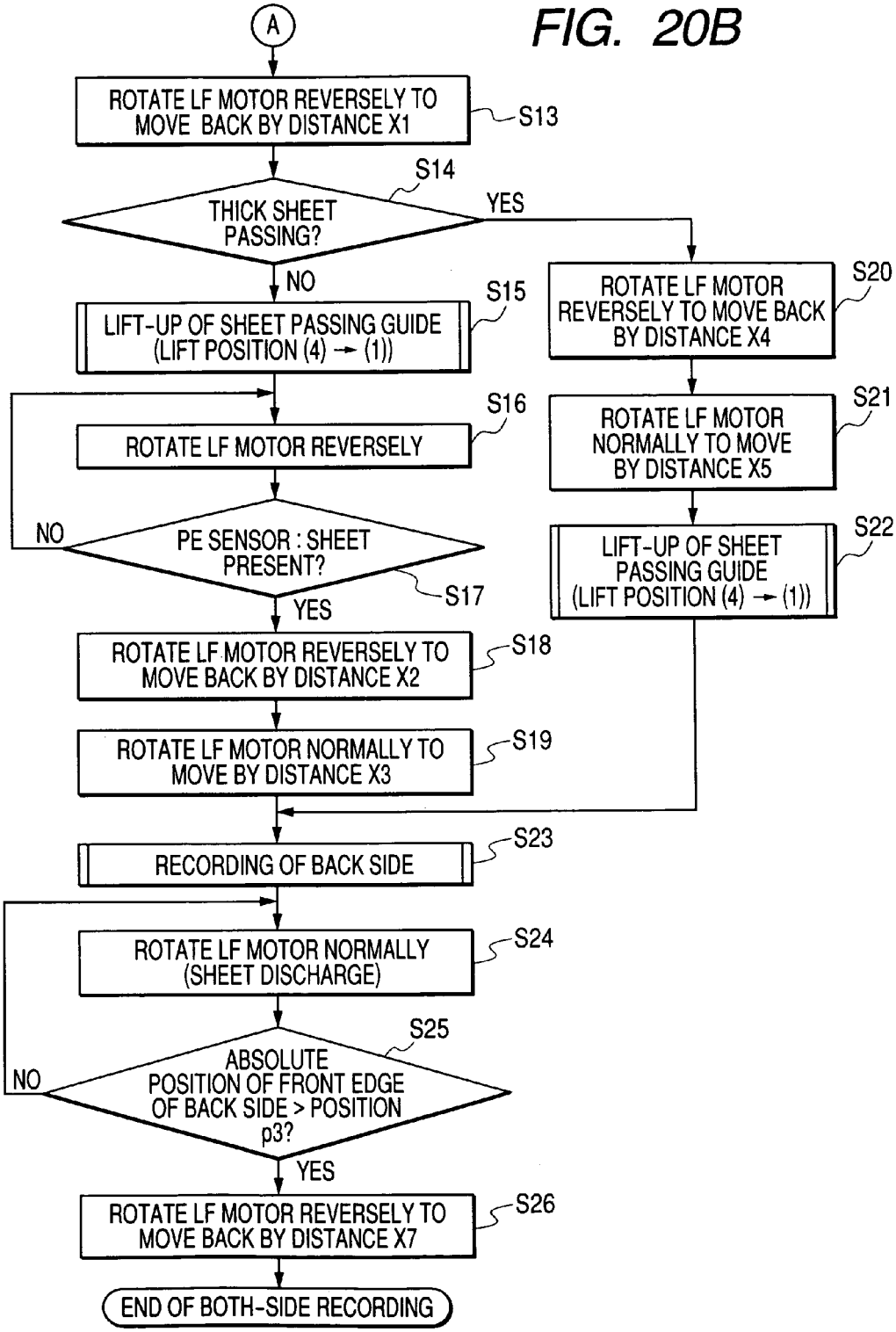

FIGS. 16A, 16B, 16C, 16D, 16E and 16F are schematic lateral cross-sectional views of the drive mechanism for the rollers of the auto both-side unit 2 shown in FIG. 15, in respective function states. Also FIGS. 20A and 20B are flow charts showing an operation sequence of an auto both-side recording. The auto both-side recording operation will be explained in the following, with reference to the flow chart.

When an auto both-side recording is initiated, a step S1 executes feeding of a recording sheet 4. For example the recording sheet 4 is fed from the main ASF 37 toward the sheet conveying roller 21.

Then a step S2 executes a recording of a front (top) side. This operation is similar to a one-side recording. In this operation, the roller drive mechanism is in a state shown in FIG. 16A.

Figure 16A:
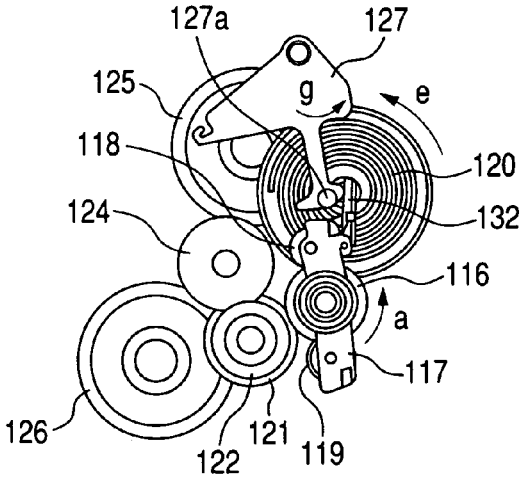
FIGS. 16A, 16B, 16C, 16D, 16E and 16F are schematic lateral cross-sectional views showing, in sequence, function states of the auto both-side unit driving mechanism of the recording apparatus in an embodiment of the present invention.

FIG. 16A shows a state where the LF motor 26 rotates in the normal direction after an initialization of the drive mechanism of the auto both-side unit 2. This corresponds to a state during a front side recording operation in an auto both-side recording, or during an ordinary recording operation not utilizing the auto both-side recording. The follower pin 127*a* of the stop arm 127 is in the innermost endless track of the spiral groove gear 120, whereby the both-side pendulum arm 117 tends to rock in the direction of the arrow a in FIG. 15 but impinges on the stop arm 127 and cannot rock any more, so that the both-side planet gear A 118 cannot mesh with the both-side roller idler gear 124. Therefore, the driving power from the LF motor 26 is not transmitted to the both-side roller gear A 125 nor the both-side roller gear B 126. For this reason, there is not generated an unnecessary load for rotating the both-side roller A 108 or the both-side roller B 109 causing an axial loss under the pressure of the both-side pinch roller A 112 or the both-side pinch roller B 113, and the load to the LF motor 26 can be minimized.

Then, when the recording on the front side is completed, a step S3 confirmed whether the rear end of the recording sheet has been detected by the PE sensor 67. In case the PE sensor 67 still detects the presence of the recording sheet 4, the rear end of the front side thereof is not yet detected and a step S4 continues the rotation of the LF motor 26 in the normal direction to move the recording sheet 4 until the rear end of the front side thereof reaches a position p2 a little beyond the PE sensor lever 66.

Then a step S5 calculates the length of the recording sheet 4, based on the conveying amount of the recording sheet 4 from the detection of the front edge of the front side of the recording sheet 4 to the detection of the rear edge by the PE sensor 67. A recording sheet 4 having a length shorter than a predetermined length L1 has to be excluded from the auto both-side recording operation as explained before, since the front edge of the recording sheet 4 cannot reach the roller in the conveying from the sheet conveying roller 21 to the both-side roller B 109 or in the conveying from the both-side roller 108 to the sheet conveying roller 21. Also a recording sheet 4 having a length longer than a predetermined length L2 has to be excluded from the auto both-side recording operation, since the recorded surface of the recording sheet causes an undesirable mutual contact in the sheet path from the sheet conveying roller 21 to the auto both-side unit 2. In case a necessity for exclusion from the auto both-side recording operation is identified under these conditions, the flow proceeds to a step S6 for rotating the LF motor 26 in the normal direction thereby directly discharging the recording sheet 4 and issuing an alarm for a sheet feed error.

On the other hand, in case the length of the recording sheet is identified as suitable for the both-side recording under the aforementioned conditions, the flow proceeds to a step S7 for shifting the lift mechanisms to the third position thereby releasing the pinch roller 22.

Then a step S8 confirms whether the rear end of the front side of the recording sheet 4 has already been conveyed to a downstream side of a position p1 in the vicinity of the pinch roller 22. In case the conveying has already been made to the downstream side, a step S9 executes a back-feed by rotating the LF motor 26 in the reverse direction until the rear end of the front side reaches p1 in order to achieve a secure pinching between the sheet conveying roller 21 and the pinch roller 22 when the pinch roller 22 is returned to the contact state. In these operations, the roller drive mechanism is in a state shown in FIG. 16B. It is preferred not to interrupt the steps S2 to S8 as far as possible and to execute the step S9 before the recording sheet 4 is deformed, as explained before. In case the rear end of the front side is at an upstream side of p1, a secure pinching of the recording sheet is possible by contacting the pinch roller 22, so that the flow immediately proceeds to a step S10.

Figure 16D:
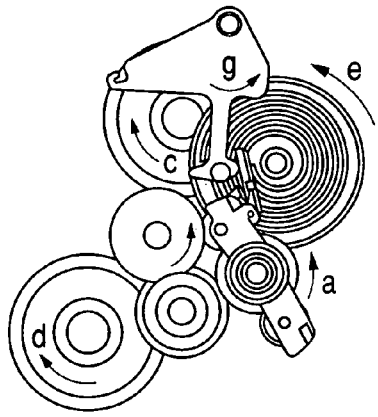
Figure 16B:
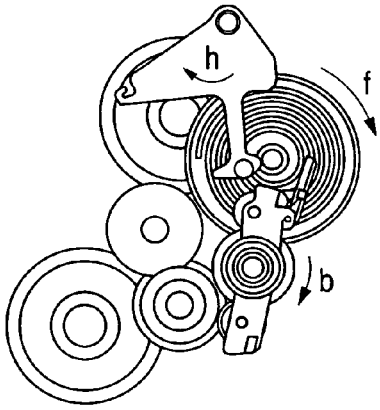

FIG. 16B shows a state immediately after the start of rotation of the LF motor 26 in the reverse direction. The roller drive mechanism of the auto inversion unit 2 assumes this state immediately after the start of the back-feed, after the completion of the front-side recording in the auto both-side recording (state shown in FIG. 16E), or in case the LF motor 26 is rotated in the reverse direction for the purpose of regulating a lead-in amount after the sheet feeding from the main ASF 37.

In this state, the rocking motion of the both-side pendulum arm 117 in the direction of the arrow b in FIG. 15 is not hindered, whereby the both-side planet gear B 119 meshes with the inversion delay gear A 121. In response, the inversion delay gear A 121 starts to rotate, but does not transmit, for about a turn, the driving power to the inversion delay gear B 122, whereby the both-side roller idler gear 124 does not rotate and the both-side roller A 108 and the both-side roller B 109 do not function. Therefore, the load to the LF motor 26 is still low in this state.

Such state is provided because, at the back-feeding of the recording sheet 4 in the auto both-side recording operation, the both-side roller B 109 need not be rotated until the front edge of the recording sheet 4 reaches the both-side roller B 109 since there is a certain distance from the sheet conveying roller 21 to the both-side roller B 109. It is also possible, for example at the regulation of the lead-in amount in the ordinary recording operation, to avoid unnecessary rotation of the both-side roller A 108 or the both-side roller B 109 as explained before.

Then a step S10 provides a waiting time until the ink recorded on the front side of the recording sheet 4 dries. Since the necessary drying time is variable by certain factors as explained before, the waiting time t1 for drying may be made a variable parameter. More specifically, t1 is determined in consideration of conditions such as a type of the recording sheet, a type of the ink, a superposed deposition method of the ink, an ink deposition amount per unit area, an environmental temperature, an environmental humidity, and an environmental air flow rate.

Then a step S11 shifts the lift mechanisms to a fourth position, whereby the recording sheet 4 is pinched again by the sheet conveying roller 21 and the pinch roller 22.

Then a step S12 provides a waiting time t2 for drying. It may be dispensed with in case the waiting for a time t1 is executed in the step S10, and, in such case, the flow may proceed to a next step, assuming t2=0. The waiting of a time t2 for drying is required in case a rear end portion of the recording sheet 4 is not subjected to a recording operation and constitutes a margin. In such case, the pinch roller 22 can be immediately pressed to such margin without any trouble, so that the step S10 does not execute the drying, by taking t1=0, and the step S12 executes a waiting of a time t2 for drying. Stated differently, in case the waiting for drying is not executed in the step S10, a back-feeding of the recording sheet 4 immediately after the step S11 may cause a transfer of the undried ink onto the pinch roller 22. Therefore a waiting for a time t2 for drying is executed in the step S12.

Then a step S13 rotates the LF motor 26 in the reverse direction, thereby back-feeding the recording sheet 4 by a predetermined amount X1. This step conveys the recording sheet 4 to the auto both-side unit 2 for front-back side inversion. After this step, a front edge of the back side returns to a position slightly in front of the sheet conveying roller 21. At this point, the roller drive mechanism assumes a state shown in FIG. 16C.

Figure 16E:
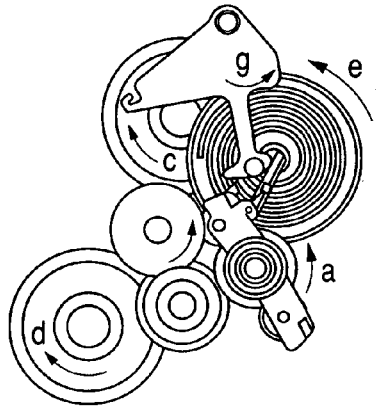
Figure 16C:
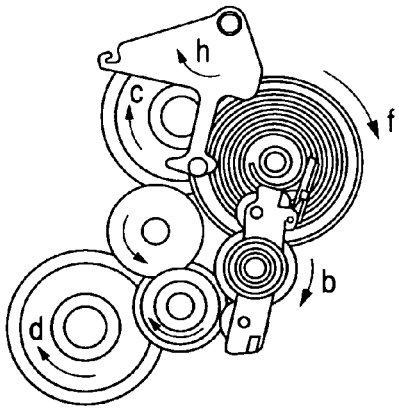

FIG. 16C shows a state where the LF motor 26 continues to rotate in the reverse direction from a state shown in FIG. 16B. This corresponds to a state where the recording sheet 4 is back-fed and inverted in the auto both-side unit 2. When the inversion delay gear A 121 rotates by about a turn after the state shown in FIG. 16B, the projection protruding in the thrust direction of the inversion delay gear A 121 engages with the opposed projection of the inversion delay gear B 122, whereby the inversion delay gear A 121 and the inversion delay gear B 122 start to integrally rotate. Since the inversion delay gear B 122 constantly engages with the both-side roller idler gear 124, the rotation of the inversion delay gear B 122 causes the both-side roller idler gear 124, the both-side roller gear A 125 and the both-side roller gear B 126 to rotate. Thus the both-side roller A 108 rotates in a direction of an arrow c in FIG. 15, while the both-side roller B 109 rotates in a direction of an arrow d in FIG. 15.

Now there will be explained so-called registration operation in case the front edge of the back side is introduced into the nip between the sheet conveying roller 21 and the pinch roller 22. At first, a step S14 switches the control according to whether the currently employed recording sheet 4 is a thin sheet of a low rigidity or a thick sheet of a high rigidity. The rigidity of the recording sheet 4 may be judged for example by the kind of the recording sheet set by the user for example in a printer driver, or by detection means for measuring the thickness of the recording sheet 4. The control is divided into two kinds because the recording sheet 4 shows different behaviors depending on the rigidity, when it is bent to form a loop.

Figure 18A:
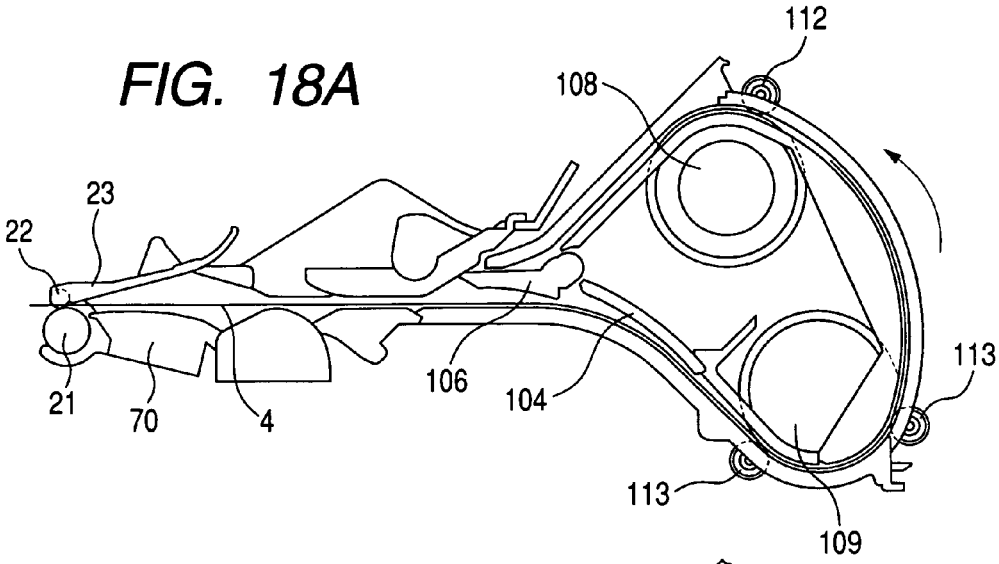
FIGS. 18A, 18B and 18C are schematic lateral cross-sectional views showing function states of a lift mechanism in a recording apparatus of an embodiment of the present invention.
Figure 18B:
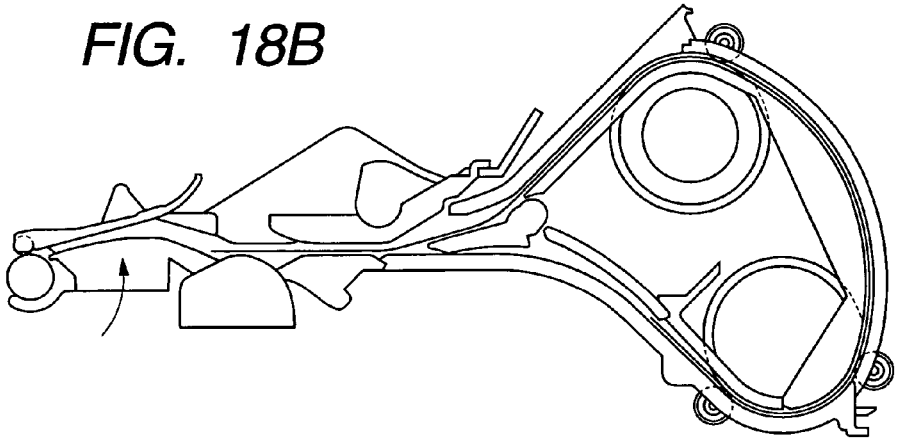
Figure 18C:
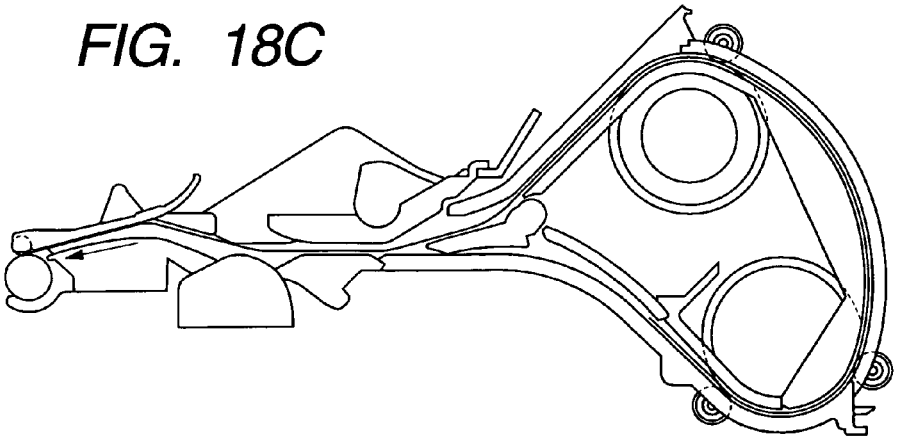

At first there will be explained a case of a thin recording sheet 4 of a relatively low rigidity. FIGS. 18A, 18B and 18C are schematic lateral cross-sectional views showing registration of the front edge of the back side in case of employing a thin recording sheet 4. The rotation of the LF motor 26 in the reverse rotation in the step S13 executes inverted conveying of the sheet shown in FIG. 18A. After the step S13, the front edge of the back side of the recording sheet 4 almost returns to the vicinity of the sheet guide 70. In case of a thin recording sheet 4, the flow proceeds then to a step S15. The step S15 shifts the lift mechanisms to the first position, thereby elevating the sheet guide 70. FIG. 18B shows a state after the end of the step S15. As the center of the pinch roller 22 is somewhat offset to the side of the first sheet discharge roller 30 with respect to the center of the sheet conveying roller 21 as explained before, the nip between the sheet conveying roller 21 and the pinch roller 22 has a certain angle with respect to the substantially horizontal direction in which the recording sheet 4 is conveyed. By returning the sheet guide 70 to the elevated position prior to the registration, it is rendered possible to smoothly guide the front edge of the back side of the recording sheet 4 into such inclined nip portion.

Then a step S16 rotates the LF motor 26 in the reverse direction, thereby further conveying the recording sheet 4 toward the sheet conveying roller 21.

Then a step S17 discriminates whether the front edge of the back side of the recording sheet 4 is detected by the PE sensor 67. Upon detection of the front edge of the back side, the flow proceeds to a step S18.

Then a step S18 conveys the recording sheet 4 by a distance X2 slightly longer than a distance from a detecting position for the front edge of the back side by the PE sensor 67 to the sheet conveying roller 21. Through this operation, the front edge of the back side of the recording sheet 4 reaches the nip portion between the sheet conveying roller 21 and the pinch roller 22, and is bent by a further conveying thereby forming a loop. FIG. 18C shows a state after the end of the step S18. The elevated position of the sheet guide 70 reduces the space of the sheet path in the direction of height, but the loop can be easily formed because of the relatively low rigidity of the recording sheet 4, and the front edge of the back side of the recording sheet 4, being pushed by the returning force of such loop, follows the nip portion between the sheet conveying roller 21 in reverse rotation and the pinch roller 22, thereby becoming parallel to the sheet conveying roller 21 and thus completing so-called registration operation.

Then a step S19 changes the LF motor 26 to the rotation in the normal direction thereby pinching the front edge of the back side of the recording sheet 4 in the nip portion and executing a conveying by a predetermined distance X3, thus completing a preparation for starting the recording on the back side.

Figure 19A:
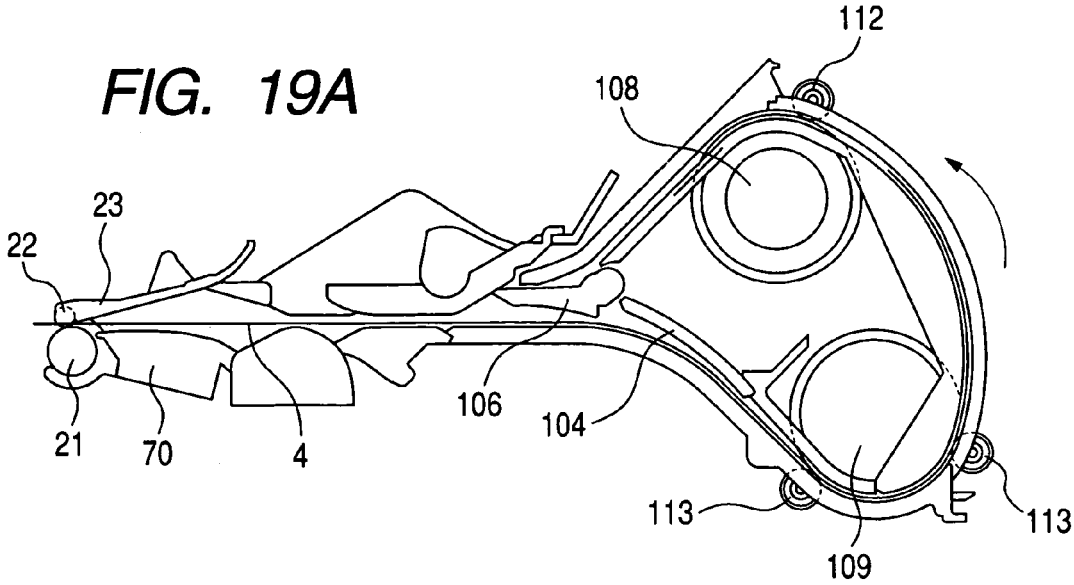
FIGS. 19A, 19B and 19C are schematic lateral cross-sectional views showing other function states of a lift cam mechanism in a recording apparatus of an embodiment of the present invention.
Figure 19B:
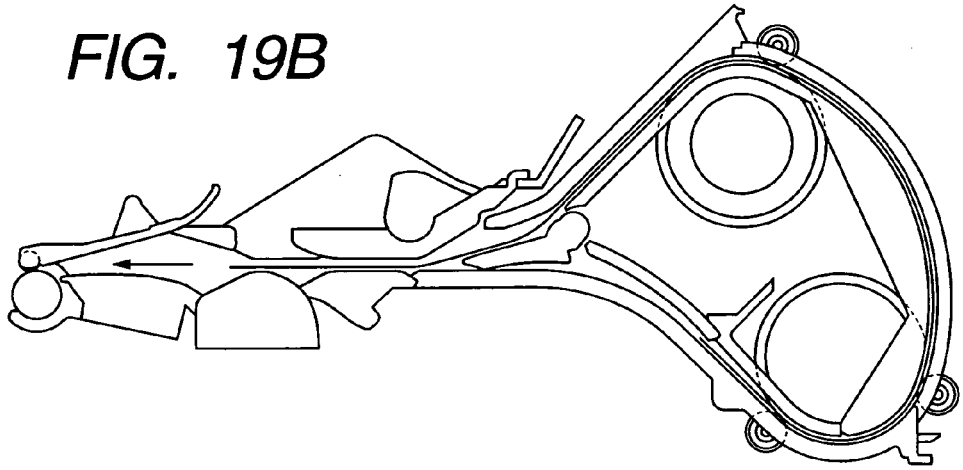
Figure 19C:
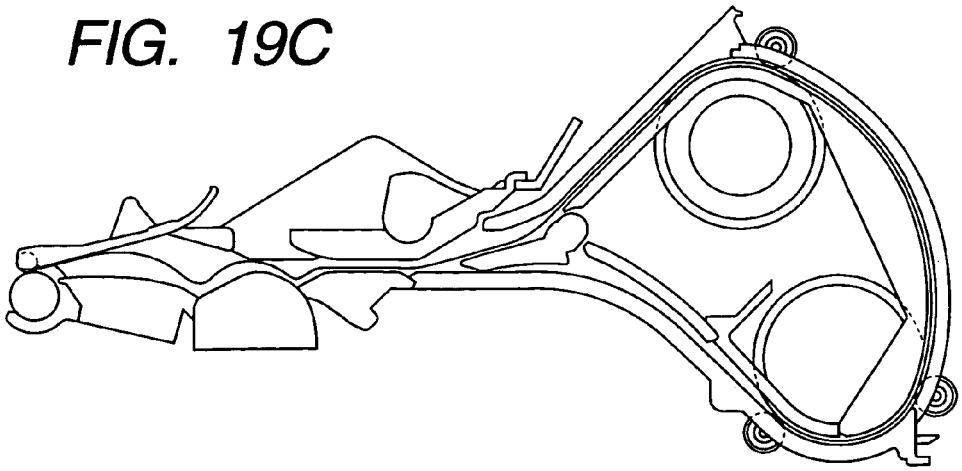

In the following, there will be explained a case of a thick recording sheet 4 of a relatively high rigidity. FIGS. 19A, 19B and 19C are schematic lateral cross-sectional views showing registration of the front edge of the back side in case of employing a thick recording sheet 4. FIG. 19A shows a state in the course of a step S13 as in FIG. 18A, and FIG. 19B shows a state after the end of the step S13.

Then a step S20, while maintaining the sheet guide 70 in the lowered position, rotates the LF motor 26 in the reverse direction, thereby conveying the recording sheet 4 by a distance X4 slightly longer than a distance from the position of the front edge of the back side of the recording sheet 4 at the end of the step S13 to the nip of the sheet conveying roller 21. Thus, as in the case of the thin recording sheet 4, the front edge of the back side of the recording sheet 4 reaches the nip portion of the sheet conveying roller 21 rotated in the reverse direction, and the recording sheet is further advanced to form a loop therein, whereby the front edge of the back side of the recording sheet 4 becomes parallel to the sheet conveying roller 21 and thus completing the registration operation. FIG. 19C shows a state at the completion of the step S20.

Then a step S21 changes the LF motor 26 to the rotation in the normal direction thereby pinching the front edge of the back side of the recording sheet 4 in the nip portion and executing a conveying by a predetermined distance X3, thus completing a preparation for starting the recording on the back side.

In the step S19 or S21, the LF motor 26 which has rotated in the reverse direction changes the rotation to the normal direction. At this point, the both-side pendulum arm 117 rocks to a direction indicated by an arrow a in FIG. 15. In response, the both-side planet gear B 119 and the inversion delay gear A 121 are disengaged. At the reverse rotation of the LF motor 26, as explained before, the inversion delay gear A 121 and the inversion delay gear B 122 are in a state mutually engaging by projections thereof, and the inversion delay gear spring 124, which is a torsion coil spring sandwiched between the two, is compressed. Thus, when the inversion delay gear A 121 is freed, the inversion delay gear spring 124 extends and the inversion delay gear A 121 rotates by about a turn in the reverse direction thereby returning to the initial state.

Then a step S22 shifts the lift mechanisms to the first position, thus completing the preparation for starting the recording of the back side.

In the following, there will be explained reason why the sheet guide 70 is maintained in the lowered state during the registration operation with the thick recording sheet 4. In case of trying to generate a loop in the same manner as in the thin recording sheet 4 as shown in FIG. 18C, a recording sheet 4 of a high rigidity is conveyed along the pinch roller holder 23 even before arriving at the nip portion of the sheet conveying roller 21. Therefore, in case of executing an additional conveying for forming a loop after the recording sheet 4 arrives at the nip portion, there is no space for loop formation since the upper surface of the recording sheet 4 is already in contact with the pinch roller holder 23 and cannot move further upwards, so that the loop is not formed.

In case a loop cannot be formed, a satisfactory registration may not be achievable. Also in case a loop is not formed, the recording sheet 4 has no slack in the state simultaneously supported by the both-side roller A 108 and the sheet conveying roller 21. In case the drive mechanism for the both-side rollers employs a mechanism such as a both-side pendulum arm 117 as in the present embodiment, when the LF motor 26 is rotated in the normal direction in the step S21 after the LF motor 26 is rotated in the reverse direction in the step S20, there is required a period for rocking of the both-side pendulum arm 117 before the both-side roller A 108 and the both-side roller B 109 are rotated, and the both-side roller A 108 and the both-side roller B 109 remain stopped during such period. On the other hand, the sheet conveying roller 21, being directly connected to the LF motor 26, has no such stopping period, thus generating a contradiction in the sheet conveying speed. If the recording sheet 4 has slack, the contradiction in the sheet conveying speed can be absorbed by taking up such slack of the recording sheet 4 when the sheet conveying roller 21 alone is rotated in the step S21. In the absence of such slack, the contradiction in the sheet conveying speed cannot be absorbed and the sheet conveying roller 21 forcedly tries to convey the recording sheet 4, but there may result a situation where the recording sheet 4 is not actually conveyed because it is pinched in a rear portion by the both-side roller A 108. Such situation may result in an erroneous conveying amount of the front edge portion of the back side of the recording sheet 4, thus providing an upper margin, on the back side, shorter than an intended value.

In the present embodiment, in order to avoid the aforementioned drawbacks, the sheet guide 70 is maintained in the lowered state in case of a thick recording sheet, thereby forming a sufficient space above the recording sheet and securing a loop forming space. It is thus rendered possible to achieve satisfactory registration even in case of using a thick recording sheet 4 of a relatively high rigidity.

Then a step S23 executes a recording operation on the back side of the recording sheet 4. At this moment, the rear end portion of the back side of the recording sheet 4 is still pinched by the both-side roller A 108 in most cases. It is undesirable to stop the rotation of the both-side roller A 108 immediately since it may become a load for pulling the recording sheet 4 backward, thus deteriorating the precision of the sheet conveying. Therefore, the drive of the both-side roller A 108 is continued at least while the rear end portion of the back side of the recording sheet 4 is pinched by the both-side roller A 108. A state of the drive mechanism for the both-side rollers is shown in FIG. 16D.

FIG. 16D shows a state of the drive mechanism for the rollers of the auto both-side unit 2 while the LF motor 26 is rotated in the normal direction after the inversion of the recording sheet 4. When the rotation of the LF motor 26 is changed to the normal direction from the state shown in FIG. 16C, the both-side pendulum arm 117 rocks in a direction of an arrow a in FIG. 15. In this state, since the stop arm 127 is rocking in a direction of an arrow h in FIG. 15, the both-side pendulum arm spring 132 does not contact the stop arm 127 when the both-side pendulum arm 117 rocks in the direction of the arrow a in FIG. 15, whereby the both-side planet gear A 118 engages with the both-side roller idler gear 124 to achieve transmission of the driving power.

When the LF motor 26 continues to rotate in the normal direction thereafter, the follower pin 127*a* is guided by the spiral groove gear 120 and moves toward the internal circumference, whereby the stop arm 127 rocks in a direction of an arrow g in FIG. 15. In the course of such rocking motion, the stop arm 127 contacts the both-side pendulum arm spring 132 thereby causing a deformation thereof. The deformation of the both-side pendulum arm spring 132 generates a repulsive force acting to rock the both-side pendulum arm 117 in the direction of an arrow b in FIG. 15, but, during the transmission of the driving power between the both-side planet gear A 118 and the both-side roller idler gear 124, a force generated by meshing of the teeth thereof is stronger, whereby the both-side planet gear A 118 and the both-side roller idler gear 124 are not disengaged and continue the drive. FIG. 16D shows such state. Also in case of an intermittent drive involving rotation and stopping, the both-side planet gear A 118 and the both-side roller idler gear 124 are not disengaged because of the meshing of the gear teeth.

When the recording operation on the back side of the recording sheet 4 is continued by the normal rotation of the LF motor 26, the follower pin 127*a* reaches the innermost circumference of the spiral groove gear 120. FIG. 16E shows the drive mechanism for the both-side rollers in such state. In this state, the both-side pendulum arm spring 132 shows a maximum displacement, but, since the load of the both-side pendulum arm spring 132 is so selected that the force generated by the meshing of the gear teeth becomes larger than the force for rocking the recording sheet both-side arm 117, the gears are not disengaged as long as the LF motor 26 continues to rotate in the normal direction. When the recording operation on the back side of the recording sheet 4 is completed, the flow proceeds to a step S24.

Then a step S24 executes a sheet discharging operation of discharging the recording sheet 4 onto an unillustrated discharge tray. The sheet discharging operation can be executed by continuing the rotation of the LF motor 26 in the normal direction, and the recording sheet 4 is eventually discharged from the main body 1 of the recording unit by the second sheet discharge roller 31 rotated by the LF motor 26.

Then a step S25 executes a confirmation of an absolute position of the front edge of the back side. This operation is executed because the follower pin 127*a* may not have reached the innermost circumference of the spiral groove gear 120 in case of a short recording sheet 4. In such situation, the process is returned to the step S24 for further rotating the LF motor 26 by a predetermined length. In this manner, the follower pin 127*a* is always brought to the innermost circumference of the spiral groove gear 120 when the back side recording operation for the recording sheet 4 is completed.

Then a step S26 executes an initialization of the drive mechanism for the both-side rollers. As the both-side pendulum arm spring 132 is maintained in a charged state by the engagement of the both-side planet gear A 118 and the both-side roller idler gear 124, they can be easily disengaged by a little rotation of the LF motor 26 in the reverse direction. More specifically, in response to a rotation of the LF motor 26 in the reverse direction, the both-side pendulum arm 117 tends to rock in a direction of an arrow b in FIG. 15, whereby the both-side planet gear A 118 and the both-side roller idler gear 124 are disengaged and the both-side pendulum arm 117 rocks at once in the direction of an arrow b in FIG. 15, by a returning force of the charged both-side pendulum arm spring 132.

Figure 16F:
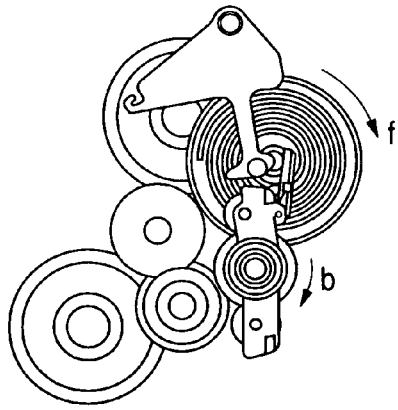

FIG. 16F shows the drive mechanism for the both-side rollers at such state. In case the LF motor 26 is rotated in the normal direction in this state where the both-side pendulum arm spring 132 has returned to the original state, the both-side pendulum arm 117 tends to rock in a direction of an arrow a in FIG. 15 but, since the follower pin 127*a* is positioned in the vicinity of the innermost circumference of the spiral groove gear 120, the both-side pendulum arm spring 132 impinges on the stop arm 127 and the both-side planet gear A 118 cannot engage with the both-side roller idler gear 124. Even if the LF motor 26 is further rotated in the normal direction, the follower pin 127*a* continues to rotate on the innermost circumference of the spiral groove gear 120, so that the both-side roller A 108 and the both-side roller B 109 cannot be driven.

In this manner the stop arm 127 and the both-side pendulum arm 117 are returned to the initial state. Also as the inversion delay gear A 121 is already initialized in the step S19 or S21, the step S26 completes the initialization of the drive mechanism for all the both-side rollers.

Thus the auto both-side recording operation is terminated. A same sequence is repeated in case of executing an auto both-side recording operation in continuation.

In the present embodiment, there has been shown a configuration in which the both-side pendulum arm spring 132 exerts an elastic force between the both-side pendulum arm 117 and the stop arm 127, but the present invention is not limited to such configuration and may also be constructed as follows.

FIGS. 17A, 17B, 17C, 17D and 17E are schematic perspective views showing a roller drive mechanism in a variation of that shown in FIGS. 16A, 16B, 16C, 16D, 16E, 16E and 16F in function states similar to those shown therein. A both-side pendulum arm 117 shown in FIGS. 17A, 17B, 17C, 17D and 17E is provided with an arm of a low elasticity in place for the both-side pendulum arm spring 132 in FIGS. 16A, 16B, 16C, 16D, 16E, 16E and 16F, and such arm and the stop arm are so arranged as to mutually impinge in the course of operation. Functions in this configuration will be briefly explained in the following.

Figure 17A:
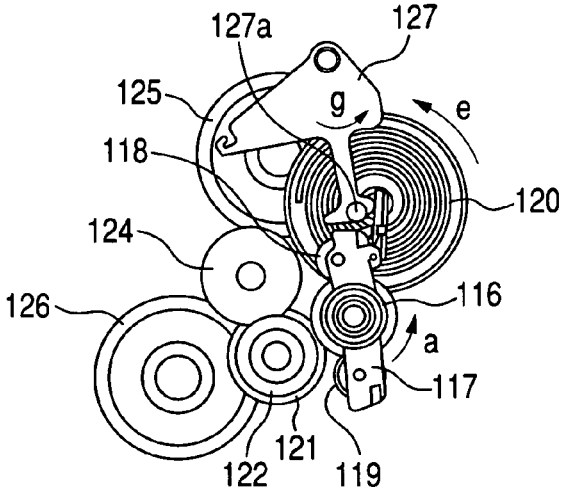
FIGS. 17A, 17B, 17C, 17D and 17E are schematic lateral cross-sectional views showing, in sequence, function states in a variation of the auto both-side unit driving mechanism of the recording apparatus in an embodiment of the present invention.
Figure 17D:
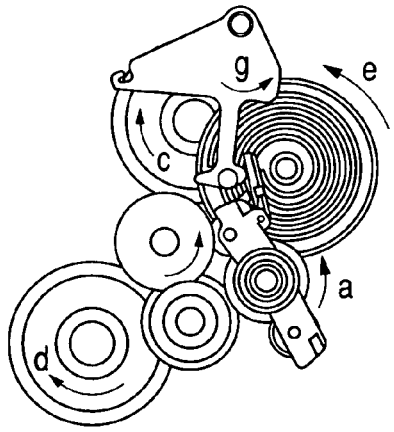
Figure 17B:
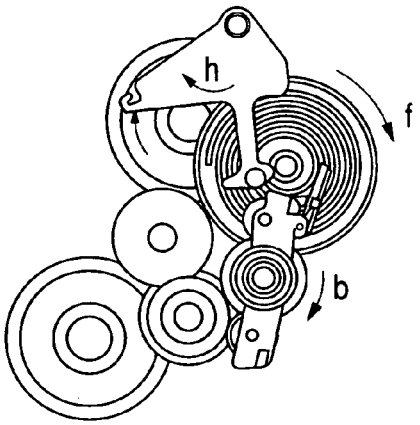
Figure 17E:
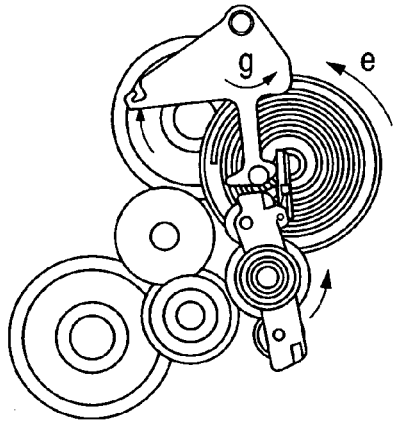
Figure 17C:
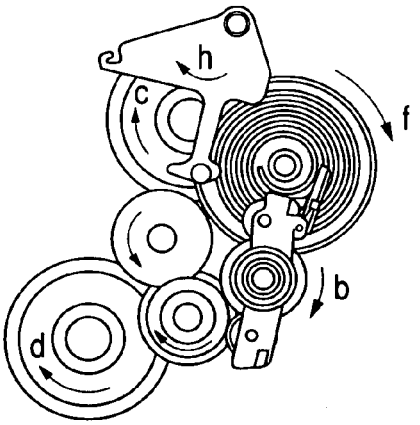

Functions from FIGS. 17A to 17C are similar to those shown in FIGS. 16A to 16C and will not, therefore, be explained further.

FIG. 17D shows a state where the stop arm 127 has moved toward the internal circumference of the spiral groove gear 120 and impinges on the arm of the both-side pendulum arm 117. When the LF motor 26 continues to rotate in the normal direction from this state, the arm of the both-side pendulum arm 117 is pushed by the stop arm 127 rocking in a direction g, thereby exerting a rotating force in a direction of an arrow b in FIG. 15 on the both-side pendulum arm 117. Such force acts in a direction to disengage the both-side planet gear A 118 and the both-side roller idler gear 124. Such disengaging force is balanced with a pressure between the teeth of the both-side planet gear A 118 and the both-side roller idler gear 124 and an elastic and sliding force of such gear teeth, but, since the arm of the both-side pendulum arm 117 does not have much elasticity, the disengaging force becomes larger as the follower pin 127*a* moves toward the internal circumference and overcomes the forces between the gear teeth, thereby forcedly disengaging the both-side planet gear A 118 and the both-side roller idler gear 124. The rotation of the both-side roller A 108 and the both-side roller B 109 is stopped simultaneously with the disengagement. This state is shown in FIG. 17E.

Such stopping of the roller rotation is selected at a suitable timing, in the step S23, after the rear end of the back side of the recording sheet 4 has passed the both-side roller A 108. After the disengagement of the gears, the both-side pendulum arm 117 is prevented from rocking in the direction of an arrow a in FIG. 15 by the stop arm 127 even if the LF motor 26 is rotated in the normal direction, so that the auto both-side unit 2 is not driven until the LF motor 26 is next driven in the reverse direction by a predetermined amount. Also as in the embodiment shown in FIGS. 16A, 16B, 16C, 16D, 16E, 16E and 16F, the inversion delay gear A 121 is initialized in the step S19 or S21, so that the initialization of the drive mechanism for the roller of the auto both-side unit 2 is completed at this point. This variation allows to relieve the LF motor 26 from the loads of rotating the both-side roller A 108 and the both-side roller B 109 during the back side recording operation, thereby alleviating the rotational load of the LF motor 26. In the foregoing, there has explained a variation of the roller drive mechanism for the auto both-side unit 2.

In the foregoing, there has been given an explanation on the auto both-side recording operation, with reference to an operation sequence shown in a flow chart.

In the both-side recording apparatus of the present invention, as explained in the foregoing, the conveying path of a sheet inversion unit is so constructed that a recorded surface of a recording sheet is positioned inside and is contacted with a drive roller formed by an elastic member of a large diameter, to reduce a possibility that the recorded portion of the recording sheet causes a friction with the conveying roller thus leading to a peeling of a recording material and a deterioration of the recorded result, thereby improving reliability and enabling satisfactory both-side recording.

It is also possible, even in case a friction or scrape is generated between the recorded portion of the recording sheet and the conveying roller, to reduce a possibility that the recording material transferred onto the conveying roller is re-transferred onto another portion of the recording sheet to deteriorate the recorded result, and thus also improving the reliability.

It is further made possible to reduce a frequency that a given portion of the conveying roller contacts the recorded portion, thereby further decreasing the possibility of friction or re-transfer, thereby further improving the reliability.

What is claimed is:

1. A recording apparatus for recording on a recording medium by a recording head, said apparatus comprising:

a conveying roller provided upstream of the recording head to convey the recording medium;

a first both-side roller for inverting the recording medium of which one side has been subjected to recording by the recording head, said first both-side roller being driven by a motor and abutted with the one side of the recording medium, which has been subjected to the recording;

a first pinch roller rotated by moving with said first both-side roller, and abutted with the other side of the recording medium, which has not been subjected to the recording;

a second both-side roller provided downstream of said first both-side roller, for inverting the recording medium of which the one side has been subjected to the recording by the recording head, said second both-side roller being driven by the motor and abutted with the one side of the recording medium, which has been subjected to the recording; and a second pinch roller rotated by moving with said second both-side roller, and abutted with the other side of the recording medium, which has not been subjected to the recording.

2. An apparatus according to claim 1, wherein a diameter of said first both-side roller is greater than that of said first pinch roller, and a diameter of said second both-side roller is greater than that of said second pinch roller.

3. An apparatus according to claim 1, wherein said first both-side roller and said second both-side roller are provided at an inner side of a conveying path of the recording medium and said first pinch roller and said second pinch roller are provided at an outer side of the conveying path of the recording medium.

4. An apparatus according to claim 1, wherein the recording head executes recording by an ink jet process.

5. An apparatus according to claim 1, wherein each of said first both-side roller and said second both-side roller comprises an elastic roller, and each of said first pinch roller and said second pinch roller comprises a non-elastic roller.

6. An apparatus according to claim 5, wherein each elastic roller is formed of rubber or an elastomer.

7. An apparatus according to claim 5, wherein each non-elastic roller is formed of a polymer resin.

* * * * *

UNITED STATES PATENT AND TRADEMARK OFFICE

CERTIFICATE OF CORRECTION

PATENT NO. : 7,114,867 B2
APPLICATION NO. : 10/822658
DATED : October 3, 2006
INVENTOR(S) : Ohashi et al.

It is certified that error appears in the above-identified patent and that said Letters Patent is hereby corrected as shown below:

ON THE TITLE PAGE:
At Item (56), References Cited, Foreign Patent Documents:

"JP 2001261181 A * 9/2001" should read --JP 2001-261181 A * 9/2001--,
"JP 2002127541 * 5/2002" should read --JP 2002-127541 A * 5/2002--,
"JP 2003002491 A * 1/2003" should read --JP 2003-002491 A * 1/2003--.

At Item (56), References Cited, Other Publications, "Machine translation of JP 20011261181" should read --Machine translation of JP 2001-261181--.

COLUMN 3:
Line 23, "life" should read --lift--.
Line 67, "flow charts" should read --flowcharts--.

COLUMN 4:
Line 26, "sheet" should read --sheets--.

COLUMN 5:
Line 8, "to" should read --to a--.
Line 13, "holder 23" should read --holder 23,--.
Line 14, "FIG. 9" should read --FIG. 9,--.
Line 17, "FIG. 3" should read --FIG. 3,--.
Line 52, "FIG. 3" should read --FIG. 3,--.

COLUMN 6:
Line 5, "heat" should read --head--.
Line 18, "such" should read --such an--.

COLUMN 11:
Line 26, "following" should read --following,--.

COLUMN 13:
Line 29, "allow to detect" should read --allow detecting--.
Line 40, "even it is" should read --even if it is--.

COLUMN 15:
Line 18, "mounted 48" should read --48 mounted--.
Line 50, "of" should read --of a--.
Line 55, "result" should read --result a--, and "an" should be deleted.

UNITED STATES PATENT AND TRADEMARK OFFICE

CERTIFICATE OF CORRECTION

PATENT NO. : 7,114,867 B2
APPLICATION NO. : 10/822658
DATED : October 3, 2006
INVENTOR(S) : Ohashi et al.

It is certified that error appears in the above-identified patent and that said Letters Patent is hereby corrected as shown below:

COLUMN 18:
Line 29, “operation” should read --operation,--.
Line 59, “rate etc.” should read --rate, etc.,--.

COLUMN 21:
Line 18, “flow chart.” should read --flowchart.--.
Line 30, “reason” should read --reasons--.

COLUMN 22:
Line 41, “little” should read --little of--.

COLUMN 25:
Line 25, “the” should be deleted.
Line 34, “allows to rotate” should read --allows rotation of--.
Line 41, “and,” (second occurrence) should be deleted.

COLUMN 26:
Line 18, “provides” should read --provides the--.
Line 58, “plant” should read --planet--.

COLUMN 27:
Line 20, “normal-direction” should read --normal direction--.
Line 44, “flow chart.” should read --flowchart.--.
Line 48, “flow” should read --flow- --.
Line 51, “flow chart.” should read --flowchart.--.

COLUMN 30:
Line 13, “explained” should read --explained a--.

COLUMN 31:
Line 5, “completing” should read --completing a--.
Line 59, “reason” should read --reasons--.

COLUMN 34:
Line 32, “16E,” should be deleted.
Line 37, “16E,” (first occurrence) should be deleted.

UNITED STATES PATENT AND TRADEMARK OFFICE

CERTIFICATE OF CORRECTION

PATENT NO. : 7,114,867 B2
APPLICATION NO. : 10/822658
DATED : October 3, 2006
INVENTOR(S) : Ohashi et al.

It is certified that error appears in the above-identified patent and that said Letters Patent is hereby corrected as shown below:

COLUMN 35:
Line 9, "16E," (first occurrence) should be deleted.
Line 12, "allows to relieve" should read --allows relieving of--.
Line 16, "has" should read --has been--.

Signed and Sealed this

Twenty-fourth Day of June, 2008

JON W. DUDAS
*Director of the United States Patent and Trademark Office*